US007624976B2

(12) United States Patent
Koie

(10) Patent No.: US 7,624,976 B2
(45) Date of Patent: Dec. 1, 2009

(54) POST-PROCESSING APPARATUS

(75) Inventor: Masayuki Koie, Mie (JP)

(73) Assignee: Fuji Xerox Co., Ltd., Tokyo (JP)

( * ) Notice: Subject to any disclaimer, the term of this patent is extended or adjusted under 35 U.S.C. 154(b) by 83 days.

(21) Appl. No.: 11/210,686

(22) Filed: Aug. 25, 2005

(65) Prior Publication Data

US 2006/0071410 A1 Apr. 6, 2006

(30) Foreign Application Priority Data

Sep. 2, 2004 (JP) ..... P2004-256250

(51) Int. Cl.
*B65H 37/04* (2006.01)

(52) U.S. Cl. ..... 270/58.12; 270/58.02; 270/58.09; 270/58.17

(58) Field of Classification Search ..... 270/58.02, 270/58.09, 58.12, 58.17
See application file for complete search history.

(56) References Cited

U.S. PATENT DOCUMENTS

| | | | | |
|---|---|---|---|---|
| 5,901,954 | A * | 5/1999 | Allmendinger et al. | 271/221 |
| 6,290,220 | B1 * | 9/2001 | Takehara et al. | 270/58.12 |
| 6,601,846 | B2 * | 8/2003 | Saito et al. | 271/226 |
| 7,192,020 | B2 * | 3/2007 | Hayashi et al. | 270/58.11 |
| 2003/0030207 | A1 * | 2/2003 | Boss et al. | 270/58.08 |
| 2003/0190178 | A1 * | 10/2003 | Sato et al. | 399/397 |
| 2004/0207142 | A1 * | 10/2004 | Sasa et al. | 270/58.08 |
| 2005/0062210 | A1 * | 3/2005 | Kato et al. | 270/58.08 |
| 2006/0017210 | A1 * | 1/2006 | Sato et al. | 270/58.08 |
| 2006/0163795 | A1 * | 7/2006 | Reeves | 270/58.08 |

FOREIGN PATENT DOCUMENTS

| | | |
|---|---|---|
| JP | 7-49082 | 2/1995 |
| JP | 7-300270 | 11/1995 |
| JP | 8-81111 | 3/1996 |
| JP | 8-108965 | 4/1996 |
| JP | 8-192951 | 7/1996 |
| JP | 10-120276 | 5/1998 |
| JP | 2003-89462 | 3/2003 |
| JP | 2003-89463 | 3/2003 |
| JP | 2003-276933 | 10/2003 |

* cited by examiner

*Primary Examiner*—Gene Crawford
*Assistant Examiner*—Leslie A Nicholson, III
(74) *Attorney, Agent, or Firm*—Morgan, Lewis & Bockius LLP

(57) ABSTRACT

A post-processing apparatus includes a compile tray that contains a recording sheet and has a sheet end position determination portion contacting with and determine a position of an end edge of the contained recording sheet, a first sheet end alignment member that carries the recording sheet to the sheet end position determination portion and aligns the end edge, a second sheet end alignment member that moves between the sheet carrying position and a standby position, wherein the sheet carrying position is where the second sheet end alignment member contacts with the recording sheet to carry the recording sheet to a side of the first sheet end alignment member, and the standby position is separated from the recording sheet, and a second sheet end alignment member control unit that moves the second sheet end alignment member between the sheet carrying position and the standby position and changes a carrying position sustaining time to sustain the second end alignment member at the sheet carrying position according to a sheet number of the recording sheets.

3 Claims, 14 Drawing Sheets

POST-PROCESSING APPARATUS

BACKGROUND OF THE INVENTION

1. Field of the Invention

The present invention relates to a post-processing apparatus for aligning a recording sheet where an image is recorded or performing a staple work, and more particularly, to a post-processing apparatus having a sheet end alignment member for carrying (pulling) a recording sheet to a sheet end position determination portion in order to align end edges of the recording sheets received in a compile tray.

2. Description of the Related Art

Conventionally, a post-processing apparatus for containing recording sheets where an image is recorded, aligning the recording sheets, binding the recording sheet bundle aligned in the compile tray with a stapler, and ejecting the recording sheet bundle according to a command of a user has been known.

In the post-processing apparatus, in order to align sheet carrying direction end edges of the recording sheets, a sheet end position determination portion (a sheet end position determination wall) is provided to a compile tray, the recording sheets collide with the sheet end position determination wall by using a paddle (sheet end alignment member) which is driven to rotate, so that the end edges can be aligned, and the sheets can be aligned in the width direction thereof by using a tamper (a sheet side edge alignment member) (for example, JP-A-10-120276). In addition, a post-processing apparatus having plural sheet end alignment members in accordance with positions of ejected sheets or a shape of the compile tray has been known.

In JP-A-2003-276933 ([0050] to [0054], FIG. 5), there is disclosed a post-processing apparatus including a first sheet end alignment member (knurling belt 191) disposed in a vicinity of a sheet end position determination wall (a collision supporting surface 131*a*) to enable the recording sheets to collide with the sheet end position determination wall and a second sheet end alignment member (inducing paddle 160) for pulling recording sheets ejected by an ejecting roller 7 into the first sheet end alignment member (knurling belt 191).

In JP-A-2003-276933, the second sheet end alignment member is driven to rotate at a predetermined position in a predetermined time according to received recording sheets. Therefore, if the sheet number of the recording sheets contained in the compile tray increases, a distance between the second sheet end alignment member and the recording sheet on the top surface of the recording sheet bundle is reduced, so that there is a problem in that a contact pressure increases and a carrying force in a sheet end alignment direction excessively increases. If the carrying force in the sheet end alignment direction, there is a problem in that paper alignment in sheet width direction by using a tamper is not sufficiently made, or there is a problem in that the recording sheets are bended.

SUMMARY OF THE INVENTION

The present invention address problems as follows (001 and 002).

(001) To suitably adjust carrying of the recording sheets by using the second sheet end alignment member.

(002) To surely perform paper alignment in the sheet width direction even in a case where the contained sheet number of the recording sheets is large.

According to an aspect of the present invention, a post-processing apparatus includes a compile tray that contains a recording sheet where an image is recorded and has a sheet end position determination portion which contacts with an end edge of the contained recording sheet to determine a position thereof, a first sheet end alignment member that carries the recording sheet received in the compile tray to the sheet end position determination portion and aligns the end edge of the recording sheet, a second sheet end alignment member that contacts with the recording sheet received in the compile tray and rotates to carry the recording sheet to a side of the first sheet end alignment member at a sheet carrying position and is capable of moving between the sheet carrying position and a standby position separated from the recording sheet, and a second sheet end alignment member control unit that moves the second sheet end alignment member between the sheet carrying position and the standby position, and changes a carrying position sustaining time to sustain the second end alignment member at the sheet carrying position according to a sheet number of the recording sheets contained in the compile tray.

BRIEF DESCRIPTION OF THE DRAWINGS

Embodiments of the present invention will be described in detail based on the following figures, wherein:

FIG. 7A is a view for explaining a front side tamper, and FIG. 7B is a view for explaining a rear tamper;

FIG. 9A is a view for explaining a main paddle, FIG. 9B is a view for explaining a conic paddle, and FIG. 9C is a view for explaining a rotating brush;

FIG. 11A is a plan view, and FIG. 11B is view seen from a direction of arrow XIB of FIG. 11A;

DESCRIPTION OF THE EMBODIMENTS

Figure 1:
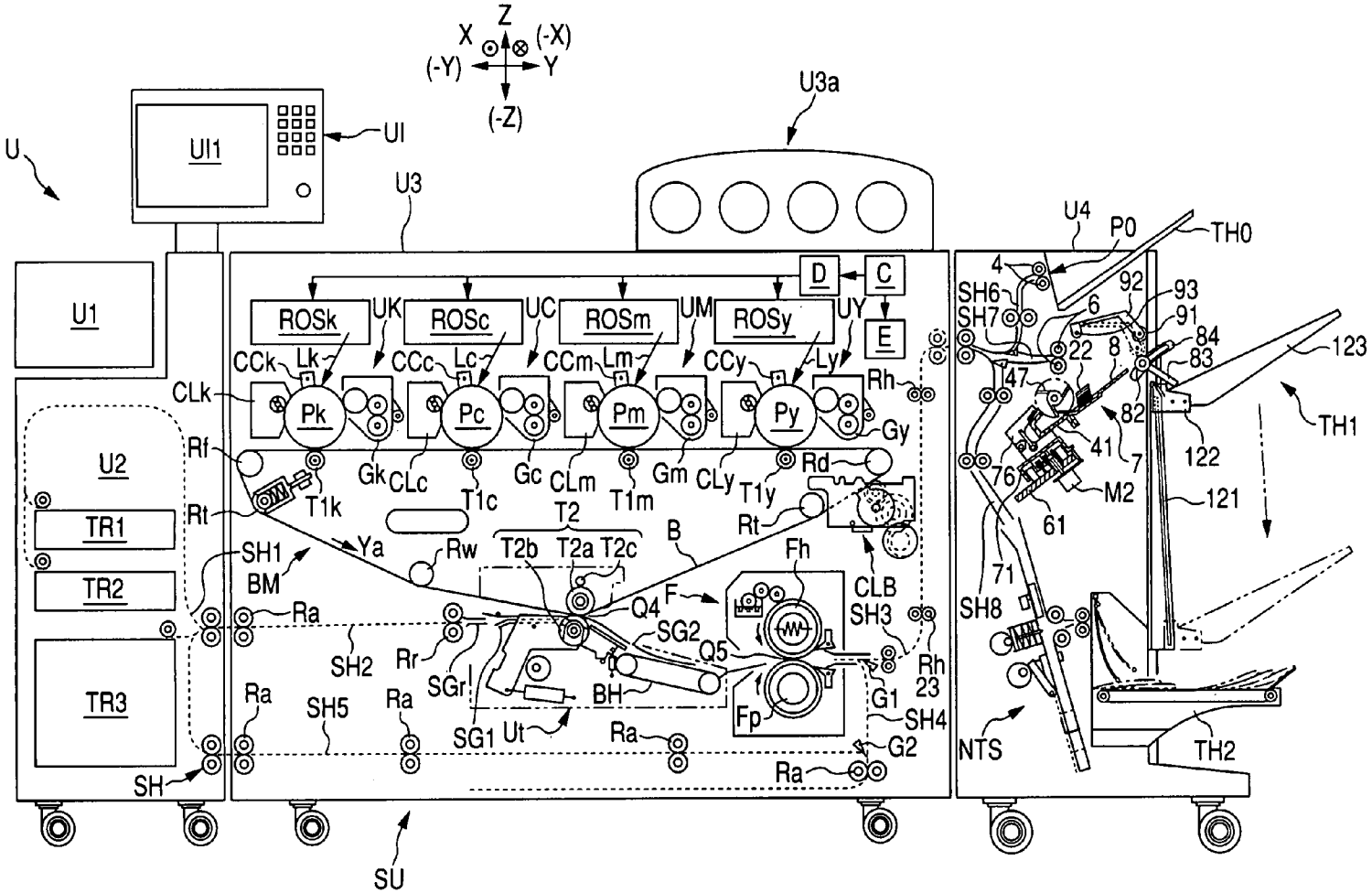
FIG. 1 is a view for explaining a whole construction of an image forming apparatus (tandem type digital color copier) according to a first embodiment of the present invention.

Now, embodiments of the aspects of the present invention will be described with reference to the accompanying drawings, but the present invention is not limited to the following embodiments.

In addition, for support of understating the description, in the drawings, the forward and backward direction, the leftward and rightward direction, and the upward and downward direction are referred to as an X axis direction, a Y axis direction, and a Z axis direction, respectively, and directions and sides indicated by arrows X, −X, Y, −Y, Z, and −Z are referred to as front, rear, right, left, upward, and downward, or front side, rear side, right side, left side, upper side, and lower side.

In addition, in the drawings, portions indicated by "○" added with "•" denote arrows directing from a rear surface to a front surface of a paper, and portions indicated by "○" added with "×" denote arrows directing from the front surface to the rear surface of the paper.

First Embodiment

FIG. 1 is a view for explaining a whole construction of an image forming apparatus (tandem type digital color copier) according to a first embodiment of the present invention.

In FIG. 1, an image forming apparatus U comprises a UI (user interface), an image input unit U1, a feeding unit U2, an image forming apparatus main body U3, and a sheet processing unit U4.

(User Interface UI)

The UI comprises input keys such as a copy start key (not shown), plural sheet number setting keys, and numeral keys and a display device UI1.

(Image Input Unit U1):

The image input unit U1 comprises an automatic document carrying device, an image scanner, and the like.

In FIG. 1, in the image input unit U1, a reflected light from an illuminated document (not shown) is converted into image data of R (red), G (green), and B (blue) by an exposure optical system (not shown), CCD (solid image pickup device), and an image processing circuit (not shown) and input to the image forming apparatus main body U3 at a predetermined timing.

(Feeding Unit U2):

The feeding unit U2 comprises plural feeding trays TR1 to TR3 and feeding paths SH1 for taking out the recording sheets S (for image recording) contained in the respective feeding trays TR1 to TR3 and carrying the recording sheets S to the image forming apparatus main body U3.

(Image Forming Apparatus Main Body) U3:

In FIG. 1, the image forming apparatus main body U3 comprises an image recording unit (described later in detail) for performing image recording on the recording sheets S carried from the feeding unit U2, a toner dispenser unit U3*a*, a sheet carrying path SH2, a sheet ejecting path SH3, a sheet inversion path SH4, a sheet circulating path SH5, and the like.

In addition, the image forming apparatus main body U3 comprises a controller C and a laser driving circuit D and power source circuit E controlled by the controller C. The laser driving circuit D, of which operations are controlled by the controller C, outputs a laser driving signal at a predetermined timing according to the image data of Y (yellow), M (magenta), C (cyan), and K (black) input from the image input unit U1 to latent image forming apparatuses ROSy, ROSm, ROSc, and ROSk of respective color toner image forming apparatuses UY, UM, UC, and UK for respective colors. In addition, the respective color toner image forming apparatuses UY, UM, UC, and UK are supported to move between a drawing-out position for being drawn out forward the image forming apparatus main body U3 and a mounting position for being mounted in an inner portion of the image forming apparatus main body U3.

In FIG. 1, a charger CCk, developer Gk, cleaner CLk, and the like are disposed around a photosensitive drum toner image containing body Pk of the K (black) toner image forming apparatuses UK.

In addition, similar to the photosensitive drum Pk, chargers CCy, CCm, and CCc, developers Gy, Gm, and Gc, cleaners CLy, CLm, and CLc, and the like are disposed around respective the photosensitive drums Py, Pm, and Pc of the other toner image forming apparatuses UY, UM, and UC.

In FIG. 1, the photosensitive drums Py, Pm, Pc, and Pk are uniformly charged by the chargers CCy, CCm, CCc, and CCk, and after that, electrostatic latent images are formed on surfaces thereof by laser beams Ly, Lm, Lc, and Lk output from the latent image forming apparatuses ROSy, ROSm, ROSc, and ROSk. The electrostatic latent images on the surfaces of the photosensitive drums Py, Pm, Pc, and Pk are developed into color toner images of Y (yellow), M (magenta), C (cyan), and K (black) by the developers Gy, Gm, Gc, and Gk.

The toner images on the photosensitive drums Py, Pm, Pc, and Pk are sequentially overlapped and transferred on an intermediate transfer belt B by primary transfer rolls Tly, Tlm, Tlc, and Tlk and a color image is formed on the intermediate transfer belt B. The color toner image formed on the intermediate transfer belt B is carried to a secondary transfer region Q4.

In addition, in a case where there is only black image data, only the K (black) photosensitive drum Pk and developer Gk are used, and only the black toner image is formed.

After the primary transfer, remaining toner on the photosensitive drums Py, Pm, Pc, and Pk are cleaned by photosensitive drum cleaners CLy, CLm, CLc, and CLk.

The belt module BM comprises the intermediate transfer belt B, belt supporting rolls Rd, Rt, Rw, Rf, and T2*a* having a belt driving roll Rd, a tension roll Rt, a working roll Rw, plural idler rolls (free rolls) Rf, and a backup roll T2*a*, and the primary transfer roll Tly, Tlm, Tlc, and Tlk. In addition, the intermediate transfer belt B is supported to move in a direction of arrow Ya by the belt supporting rolls Rd, Rt, Rw, Rf, and T2*a*.

A secondary transfer unit Ut is disposed under the backup roll T2*a*. A secondary transfer roll T2*b* of the secondary transfer unit Ut with the intermediate transfer belt B inserted is disposed to the backup roll T2*a* in a separable and pressable (detachable/contactable) manner, and a secondary transfer region Q4 is formed by a region (nib) where the secondary transfer roll T2*b* is pressed and contacted with intermediate transfer belt B.

In addition, a contact roll T2*c* contacts with the backup roll T2*a*, and a secondary transfer unit (transfer apparatus) T2 is constructed with the rolls T2*a* to T2*c*.

A secondary transfer voltage having the same polarity as the charging polarity of the toner is applied to the contact roll T2*c* at a predetermined timing from a power source circuit controlled by the controller C.

A sheet carrying path SH2 is disposed under the belt module BM. A recording sheet S fed from a feeding path SH1 of the feeding unit U2 is carried to a register roll Rr of the sheet carrying path SH2 and carried to a secondary transfer region Q4 through a register-side sheet guide SGr and a before-transfer sheet guide SG1 in accordance with a timing when a color toner image is carried to the secondary transfer region Q4.

In addition, the register-side sheet guide SGr together with the register roll Rr is fixed to the image forming apparatus main body U3.

When passing through the secondary transfer region Q4, the color toner image on the intermediate transfer belt B is transferred on the recording sheet S by the secondary transfer unit T2. In addition, in case of a full color image, the toner images overlapped and primarily-transferred on a surface of the intermediate transfer belt B are integrally secondarily-transferred on the recording sheet S.

After the secondary transfer, the intermediate transfer belt B is cleaned by the belt cleaner CLB. In addition, the secondary transfer roll T2*b* and the belt cleaner CLB are installed to be separable/contactable with the intermediate transfer belt B and, when a color image is formed, is separated from the intermediate transfer belt B until a final color non-fixed toner image is primarily transferred to the intermediate transfer belt B.

The recording sheet S where the toner image is secondarily transferred is carried through a after-transfer sheet guide SG2 and a sheet carrying belt BH to a region (a fixing region Q5) where a pair of fixing rolls Fh of the fixing apparatus F and the pressing roll Fp are pressed and contacted with each other. When passing through the fixing region Q5, the toner image on the recording sheet S is heated and fixed by the fixing apparatus F. A changeover gate G1 is disposed to a downstream of the fixing apparatus F. The changeover gate G1 selectively change the recording sheet S which is carried through the sheet carrying path SH2 and heated and fixed on the fixing region Q5 to one of the sheet ejecting path SH3 and the sheet inversion path SH4. The sheet S carried to the sheet ejecting path SH3 is ejected from the ejecting roll Rh to the sheet post-processing apparatus U4.

A sheet circulating path SH5 is connected to the sheet inversion path SH4, and a mylar gate G2 is disposed at a connection portion thereof. The mylar gate G2 passes the recording sheet S carried to the sheet inversion path SH4 and switches back the passed recording sheet S to carry the recording sheet S to the sheet circulating path SH5. The recording sheet S carried to the sheet circulating path SH5 passes through the feeding path SH1 and is carried again to the transfer region Q4.

A sheet carry path SH is constructed with the elements denoted by the reference numerals SH1 to SH5. In addition, a sheet carrying apparatus SU is constructed with the elements denoted by the reference numerals SH, Ra, Rr, Rh, SG1, SG2, SGr, BH, G1, and G2.

(Sheet Post-Processing Apparatus U4)

Figure 2:
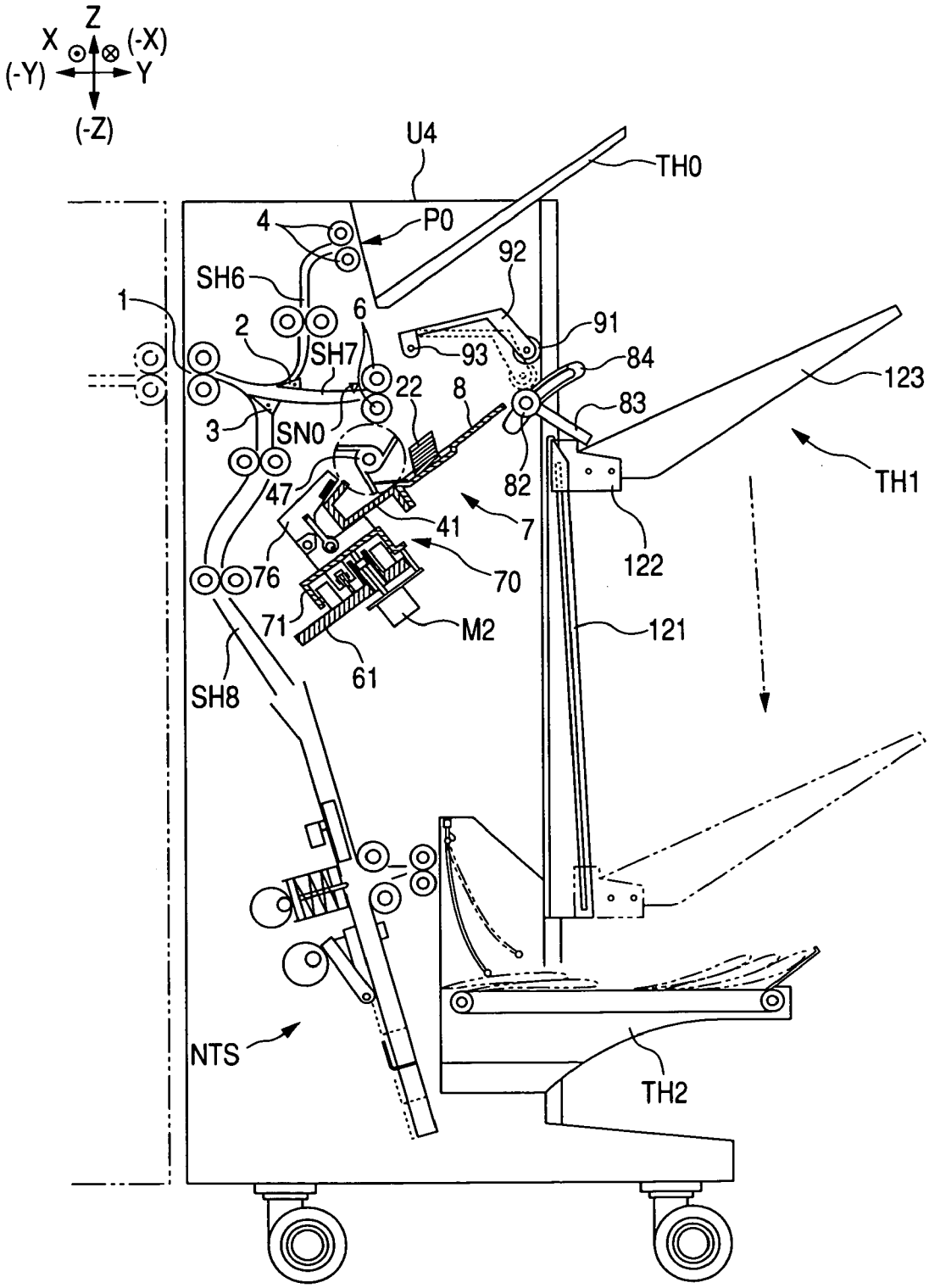
FIG. 2 is an enlarged cross sectional view of the sheet post-processing apparatus according to the first embodiment of the present invention to explain up-down movement of an ejecting clamp roller.

FIG. 2 is an enlarged cross sectional view of the sheet post-processing apparatus according to the first embodiment of the present invention to explain up-down movement of an ejecting clamp roller.

Figure 3:
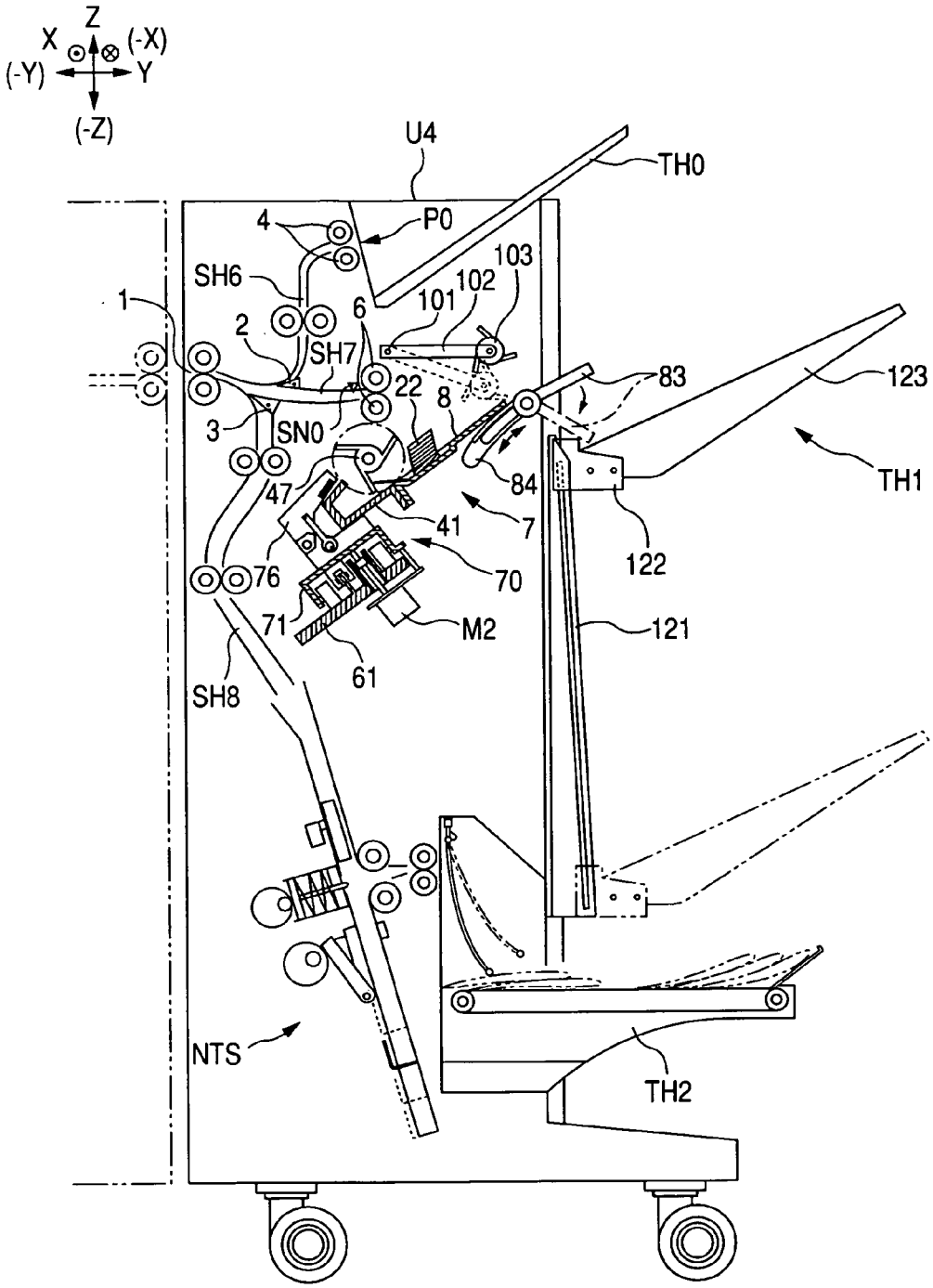
FIG. 3 is an enlarged cross sectional view of the sheet post-processing apparatus according to the first embodiment of the present invention to explain up-down movement of a sub paddle.

FIG. 3 is an enlarged cross sectional view of the sheet post-processing apparatus according to the first embodiment of the present invention to explain up-down movement of a sub paddle.

In FIGS. 2 and 3, in the sheet post-processing apparatus U4, a sheet receiving opening 1 for receiving the recording sheet S copied in the image forming apparatus main body U3 is formed on a surface (one side surface of the sheet post-processing apparatus) of contacting with image forming apparatus main body U3. The recording sheet S received from the sheet receiving opening 1 is carried to one of an upward-extending upper end ejecting path SH6, a leftward-extending end binding ejecting path SH7, and a downward-extending saddle stitching ejecting path SH8 by changing of the changeover gates 2 and 3. The recording sheet S carried to the upper end ejecting path SH6 is ejected without post-processing from an upper end ejecting opening P0 to a top tray THO by an upper end ejecting roll 4.

(End Binding Apparatus)

Figure 4:
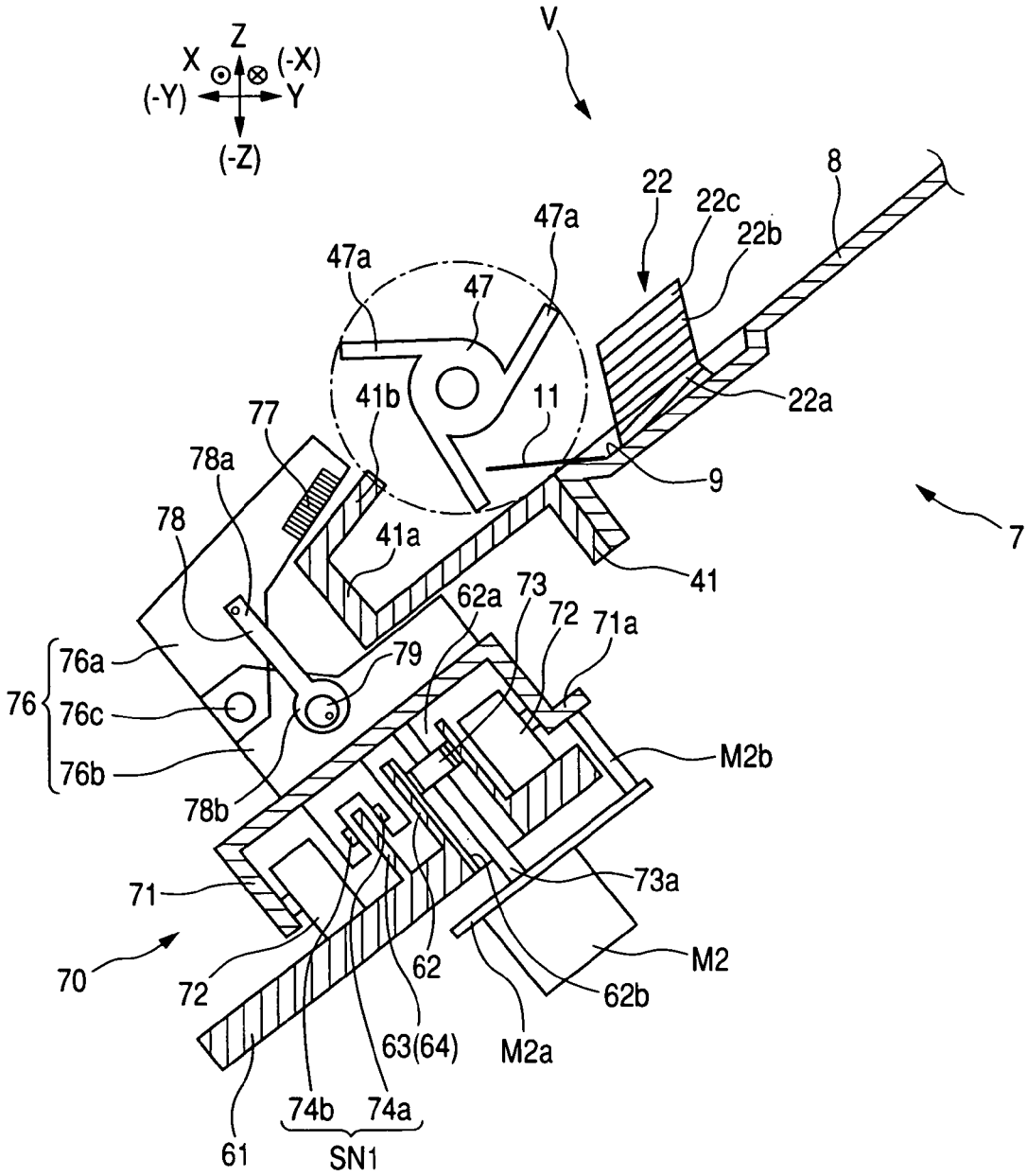
FIG. 4 is an enlarged view for explaining principal components of a sheet ejecting directional rear end portion according to the first embodiment.

FIG. 4 is an enlarged view for explaining principal components of a sheet ejecting directional rear end portion according to the first embodiment.

Figure 5:
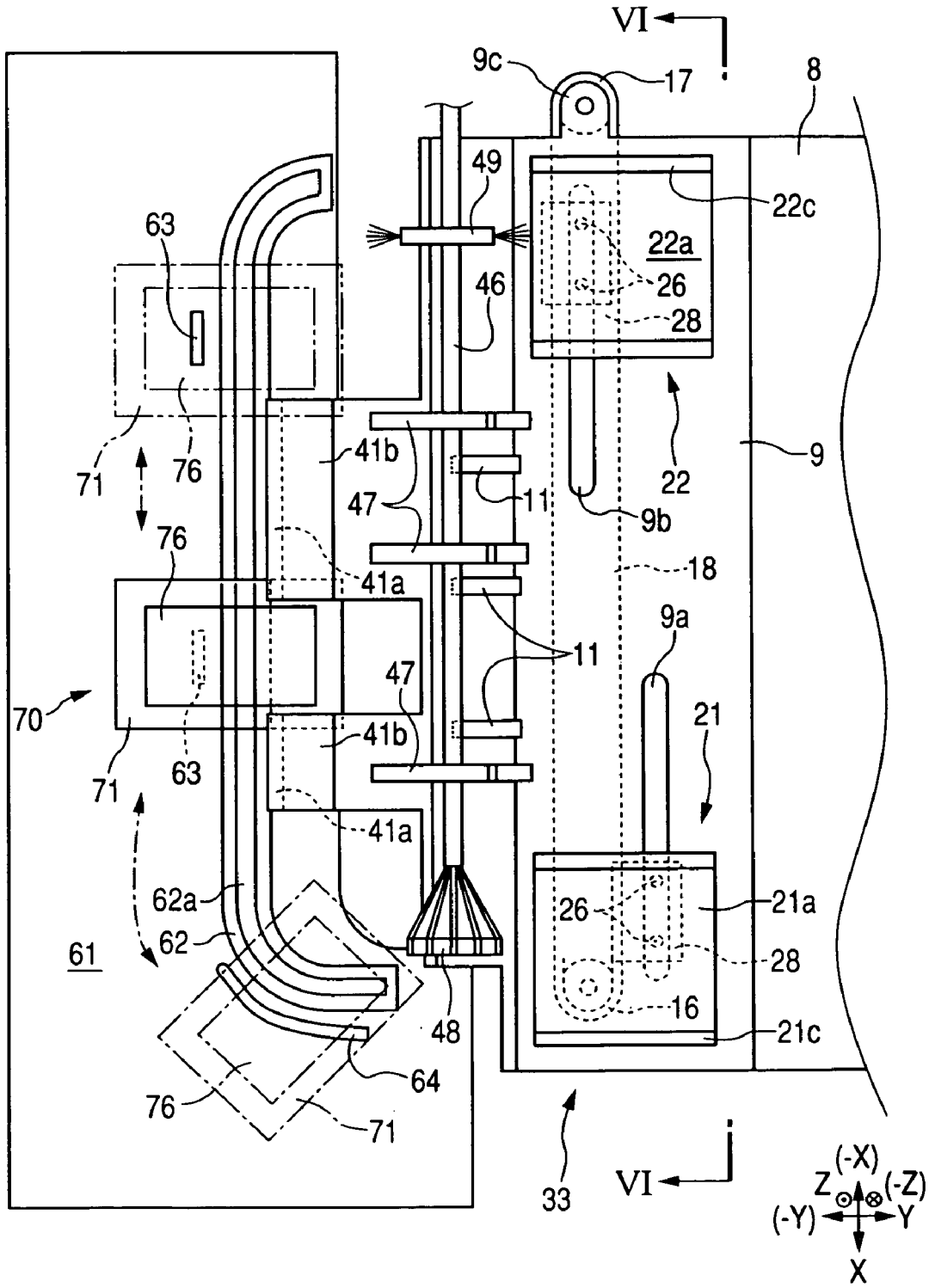
FIG. 5 is a view seen from a direction of arrow V of FIG. 4.

FIG. 5 is a view seen from a direction of arrow V of FIG. 4.

In FIGS. 2 and 3, the recording sheet S carried to the end binding ejecting path SH7 is ejected to an end binding compile tray 7 by a compile tray ejecting roll 6.

In addition, in the vicinity of the compile tray ejecting roll 6, a compile tray ejecting sheet sensor SN0 for detecting whether or not there is a recording sheet on the end binding ejecting path SH7 is disposed. The end binding compile tray 7 is disposed in a slight slanted angle with reference to a horizon and constructed to align and receive plural sheets. In FIGS. 2 to FIG. 4, the end binding compile tray 7 comprises a compile tray main body 8 where the recording sheets are mounted. A tamper moving concave portion 9 is formed in a left end portion of an upper surface of the compile tray main body 8, a pair of front and rear tamper guide grooves 9*a* and 9*b* (see FIG. 5) are formed in the tamper moving concave portion 9.

In FIGS. 4 and 5, a right end portion (base end portion) of a mylar (sheet lifting member 11) having a shape of film (thin film) is fixed and supported in a left end portion of the tamper moving concave portion 9, and the left end portion (front end portion) of the mylar 11 protrudes further upwardly in comparison to an upper surface of the compile tray main body 8. A strength of the mylar 11 according to the first embodiment lifts up the recording sheets or the recording sheet bundle in a case where a small number of recording sheets (five normal papers) are mounted on the compile tray main body 8, and the front end portion of the mylar 11 is elastically deformed by a weight of the recording sheet bundle to be closely connected with the upper surface of the end binding compile tray 7 in a case where a large number of recording sheets are mounted. Therefore, even in a case where the contained sheet number is small, a distance between the top surface of the contained recording sheet bundle and the later-described main paddle 47 can be maintained in a predetermined by the mylar 11.

(Description of Sheet Side Edge Alignment Member)

Figure 6:
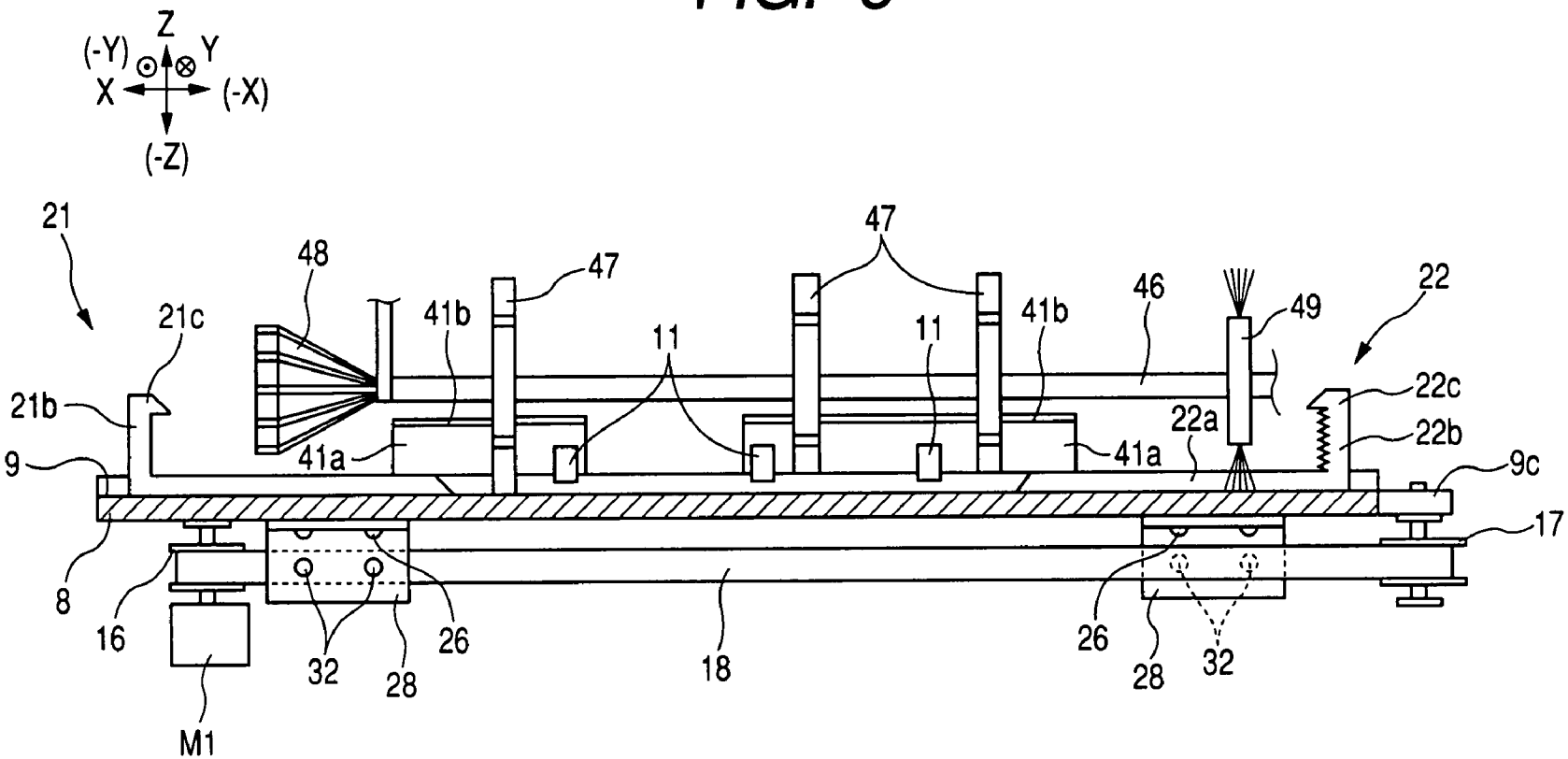
FIG. 6 is a cross sectional view taken along line VI-VI of FIG. 5.

FIG. 6 is a cross sectional view taken along line VI-VI of FIG. 5.

In FIG. 6, a tamper driving pulley 16 which can rotate normally or reversely by a tamper driving motor M1 is supported in a front portion of a lower surface of the tamper moving concave portion 9. A driven pulley 17 is supported in a rotatable manner in a pulley supporting portion 9*c* in a rear portion of the tamper moving concave portion 9. A tamper driving timing belt 18 is suspended (mounted) between the tamper driving pulley 16 and the driven pulley 17.

Figure 7A:
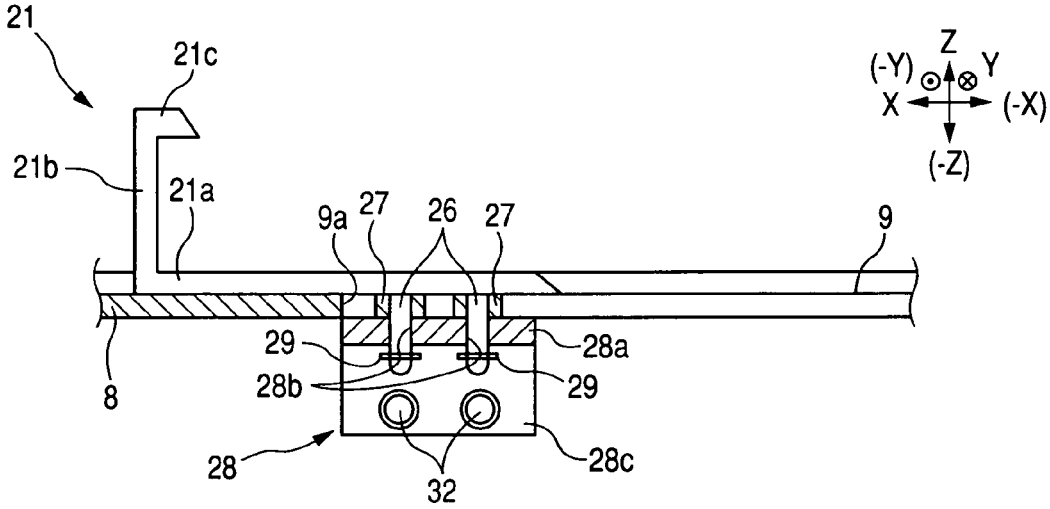
FIGS. 7A and 7B are views for explaining an end binding apparatus according to the first embodiment.
Figure 7B:
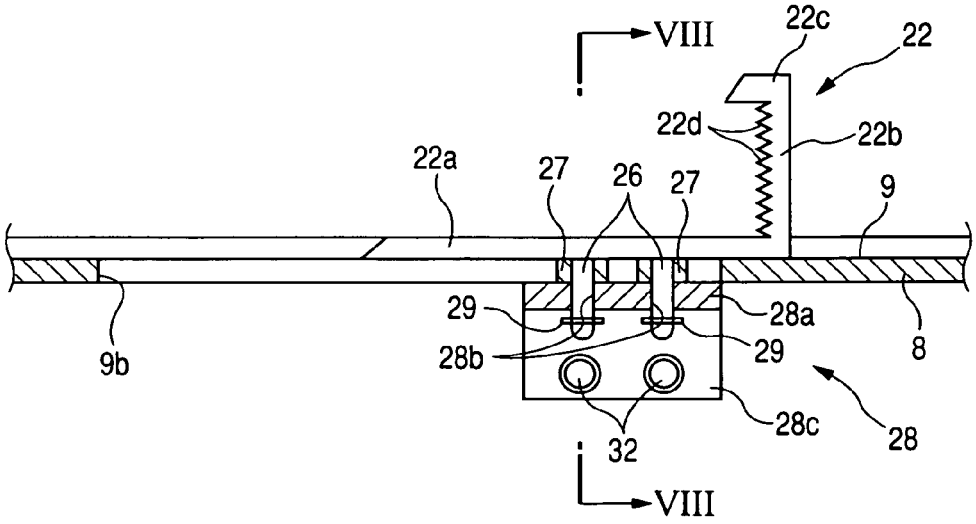

FIGS. 7A and 7B are views for explaining an end binding apparatus according to the first embodiment, FIG. 7A is a view for explaining a front side tamper, and FIG. 7B is a view for explaining a rear tamper.

In FIGS. 4 to 7B, a pair of front and rear tampers 21 and 22 for aligning front and rear edges of a sheet received to the end binding compile tray 7 are disposed in the tamper moving concave portion 8. In FIG. 7A, an upper surface of the front tamper 21 is formed to be aligned with an upper surface of the compile tray main body 8, and a rear end portion (−X end portion) comprises a downwardly-slanted sheet mounting portion tamper base 21*a* and a sheet side end alignment wall 21*b* upwardly erected from a front end of the sheet mounting portion 21*a*. In addition, a sheet side edge engagement portion 21*c* protruding toward an inner side thereof is formed at an upper end of the sheet side end alignment wall 21*b*, and the sheet side edge engagement portion 21*c* prevents a sheet front edge of the recording sheet on the end binding compile tray 7 from overriding on the front tamper 21 or a curled sheet side edge from sliding upwardly.

FIG. 7B, similar to the front tamper 21, the rear tamper 22 also comprises a sheet mounting portion (tamper base) 22*a*, a sheet side end alignment wall 22*b*, and a sheet side edge engagement portion 22*c*. In addition, plural convex parts 22*d* parallel to an upper surface of the compile tray main body 8 are formed on an inner surface (sheet side edge) of the sheet side end alignment wall 22*b* of the rear tamper 22. Therefore, by the sheet side edge engagement portion 22*c* and the convex parts 22*d*, it is possible to prevent the rear side edge of the recording sheet from overriding the rear tamper 22.

Figure 8:
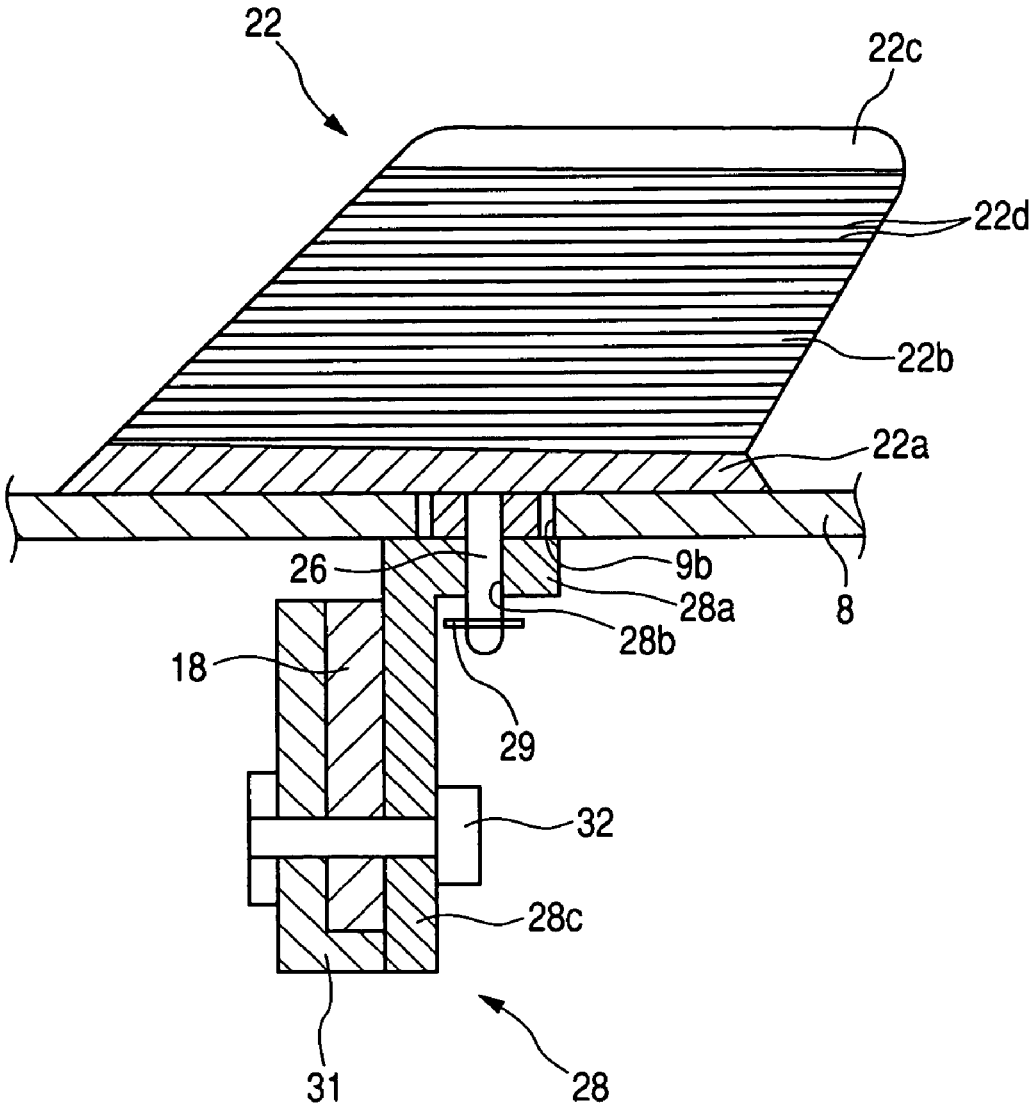
FIG. 8 is a cross sectional view taken along line VIII-VIII of FIG. 7B.

FIG. 8 is a cross sectional view taken along line VIII-VIII of FIG. 7B.

Although connections between front and rear tampers 21 and 22 and the tamper driving timing belt 18 are described later, since the connection structures between the front tamper 21 and the tamper driving timing belt 18 and between the rear tamper 22 and the tamper driving timing belt 18 are the same, the rear tamper 22 will be described in detail, but description of the front tamper 21 will be omitted.

In FIGS. 7A to 8, two guided pins 26 protrude downwardly from a lower surface of the sheet mounting portion 22*a* of the rear tamper 22. The guided pins 26 pass through the rear tamper guide grooves 9*b* and extend downwardly. A cylindrical collar 27 is engaged into the guided pins 26. In addition, the front end portions of the guided pin 26 pass through a pin through-hole 28*b* formed on an upper end wall 28*a* of an inversed-L-shaped tamper bracket 28, and a release preventing clip 29 is mounted on a front end of a guide pin 26. In FIG. 8, a connection plate 31 is disposed to face a vertical wall 28*c* of the tamper bracket 28. The tamper bracket 28 an the connection plate 31 are connected to each other by means of two connection members 32 with the tamper driving timing belt 18 interposed therebetween.

In FIG. 5, the front tamper 21 is connected to a right side of the tamper driving timing belt 18, and the rear tamper 22 is connected to a left side of the tamper driving timing belt 18. Therefore, by normally or reversely rotating the tamper driving motor M1, the front tamper 21 and the rear tamper 22 can move in a direction that the tempers are close to each other or in a direction that the tempers are separated from each other.

A sheet side edge alignment member 33 is constructed with the tamper driving motor M1, the tamper driving pulley 16, the driven pulley 17, the tamper driving timing belt 18, the tampers 21 and 22, the guided pins 26, the tamper bracket 28, the connection plate 31, the connection member 32, and the like. In addition, the construction of the sheet side edge alignment member is not limited to the aforementioned construction, but conventionally well-known constructions (for example, see JP-A-08-081111 and JP-A-08-108965) may be employed.

(Description of Sheet Rear End Position Determination Member)

In FIGS. 4 and 5, a sheet rear end position determination member 41 is fixed and supported at a left end side of a sheet ejecting directional rear end side of the compile tray main body 8. In order to determine a position of the sheet ejecting directional rear end of the recording sheet carried to the end 10 binding compile tray 7, the sheet rear end position determination member 41 comprises a rear end position determination wall (end wall, sheet end position determination portion) 41*a* erected upwardly and a sheet guide wall 41*b* extending from an upper end of the rear end position determination wall 41*a* to the compile tray main body 8. In addition, as shown in FIG. 5, the rear end position determination wall 41*a* is formed in a portion except for a staple position where a staple work for binding the recording sheet bundle with a later-described stapler is performed. In a case where the sheet rear end moving toward the sheet rear end position determination wall 41*a* is curled upwardly for the purpose of sheet alignment, the sheet rear end guide wall 41*b* has a function of guiding the sheet rear end downwardly and reducing a curl amount.

The compile tray 7 is constructed with the compile tray main body 8 and the sheet rear end position determination member 41.

In addition, although the sheet rear end position determination member 41 according to the first embodiment is fixed and supported to the compile tray main body 8, it is not limited thereto, but a rotatable rear end position determination member, for example, a conventionally well-known one (for example, see JP-A-8-192951) may be employed.

(Description of Sheet Rear End Alignment Member)

Figure 9A:
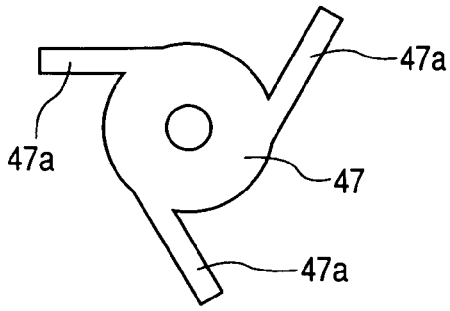
FIGS. 9A to 9C are views for explaining a sheet rear end alignment member.
Figure 9B:
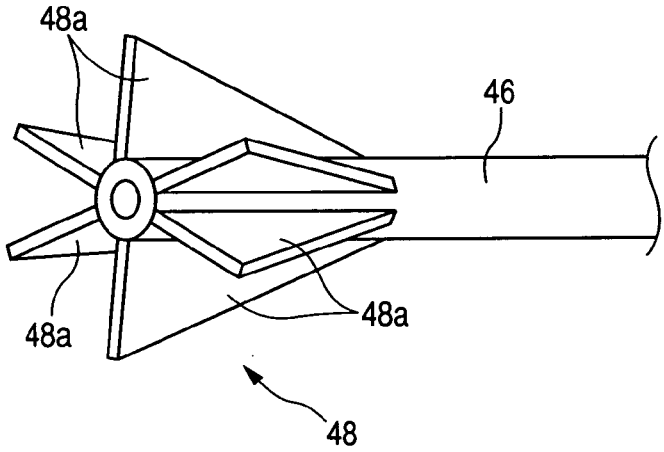
Figure 9C:
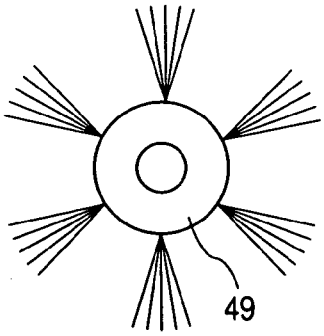

FIGS. 9A to 9C are views for explaining a sheet rear end alignment member, FIG. 9A is a view for explaining a main paddle, FIG. 9B is a view for explaining a conic paddle, and FIG. 9C is a view for explaining a rotating brush.

In FIGS. 5 and 6, a rear end alignment member supporting shaft 46 is rotatably supported to a frame (not shown) of the sheet post-processing apparatus U4 over the sheet rear end position determination member 41. The rear end alignment member supporting shaft 46 is rotationally driven by a motor (not shown) at a rear portion thereof.

In FIGS. 5 and 6, three main paddles (sheet rear end alignment member, sheet end alignment member) 47 are fixed and supported in an forward and backward direction (X axis direction) with an interval to a position corresponding to the sheet rear end position determination member 41 in the rear end alignment member supporting shaft 46. As shown in FIG. 9A, the main paddle 47 comprises three flexible sheet contact portions 47*a* to carry the recording sheet to the rear end position determination wall 41*a* with the upper surface of the recording sheet of the end binding compile tray 7 or the top surface of the recording sheet bundle contacted.

The sheet contact portions 47*a* extend in a tangential direction at a position deviated by about 120° from a circumferential direction of a cylindrical surface. In addition, the number and the arrangement position of the sheet contact portions 47*a* are not limited to three and 120°, but any numbers and positions for example one, two and 180°, four and 90°, five and 72°, and six and 60° may be employed. In addition, the extending direction of the sheet contact portion 47*a* is not limited to the tangential direction, but a radial direction may be employed.

In addition, in the main paddles 47 according to the first embodiment, in a case where the recording sheet bundle contained in the end binding compile tray 7 is large, a distance between the main paddle 47 and the end binding compile tray 7 is set, so that the contacting press between the sheet contact portion 47*a* and the recording sheet becomes a suitable pressure.

In FIGS. 5, 6, and 9B, a conic paddle 48 is fixed to a front end portion of the rear end alignment member supporting shaft 46. The conic paddle 48 is sheet side edge guiding rotation member for guiding one side edge of the recording sheet (moving forwardly) downwardly and comprises a conic rotation surface of which outer diameter is enlarge forwardly.

Namely, as shown in FIG. 9B, the conic paddle 48 comprises six fin members 48*a* extending in a radial direction at a position deviated by about 60° in a circumferential direction of the cylindrical surface, and an outer edges of the fin members 48*a* constitute a cylindrical surface at a time of rotation. When an upwardly-curled sheet is pushed into a front portion of the X direction, the conic paddle 48 has a function of directing the upwardly-curled portion of the sheet downwardly.

In addition, the rotating brush 49 (see FIGS. 5 and 6) is fixed in the rear end portion (−X side end portion) of the rear end alignment member supporting shaft 46. In FIG. 9C, the rotating brush 49 comprises plural brush hairs (line-shaped members) extending in a radial direction at a position deviated by about 60° in a circumferential direction of the cylindrical surface. The rotating brush 49 has a function of pressing the curl of the sheet rear end portion downwardly.

In addition, in the present invention, the conic paddle 48 and the rotating brush 49 may be omitted.

(Description of Stapler Guide Member)

In FIGS. 4 and 5, a stapler guide member 61 is fixed and supported to the frame (not shown) of the sheet post-processing apparatus U4 under the left side of the sheet rear end position determination member 41. In the stapler guide member 61, an inwardly-arc-bent stapler guide member 62 extends linearly in a forward and backward direction and protrudes upwardly at both front and rear end portions. In the stapler guide member 62, a stapler guide groove 62*a* is formed along the stapler guide member 62. On one inner surface of the stapler guide groove 62*a*, gear teeth 62*b* (see FIG. 4) are formed.

In addition, in the front and rear ends of the stapler guide groove 62*a*, snap-fit coupling members are formed to prevent a later-described moving staple member from moving up to the front end side or the rear end side.

In FIG. 5, in a left side of the stapler guide groove 62*a*, two staple position light-shielding portions (staple position detection portions) 63 are disposed corresponding to a staple position for performing a staple work of binding the side ends of the recording sheet. The staple position light-shielding portion 63 is elongated in a forward and backward direction along a line-shaped guide groove 62*a*. In addition, in a front end portion of the stapler guide member 61, a groove position light-shielding portion (groove position detection portion) 64 is formed along the arc-bent portion of the guide groove 62*a*.

In addition, the staple position light-shielding portion 63 according to the first embodiment is set with a forward and backward length of 12.6 mm. In addition, the groove position light-shielding portion 64 according to the first embodiment is formed with a length (for example, 50 mm) which is sufficiently longer that a length of the staple position light-shielding portion 63, and used to detect a groove position as well as a corner binding staple position for performing a corner binding work for binding corners of the sheet bundle.

(Description of Moving Staple Member)

In FIGS. 4 and 5, a moving staple member 70 is disposed on the stapler guide member 61. The moving stapler 70 has a moving wheel 71, and a shaft supporting portion 71*a* is formed in a right end portion (+Y end portion) of the moving wheel 71. In the moving wheel 71, a roller 72 is supported in a rotatable manner, and the moving wheel 71 is constructed to move on the stapler guide member 61. On a lower surface of the moving wheel 71, a guide gear 73 is supported in a rotatable manner. The guide gear 73 is inserted into the stapler guide groove 62*a* and engaged into gear teeth 62*b*. A rotating shaft 73*a* of the guide gear 73 passes through the stapler guide groove 62*a*, and a stapler driving motor M2 is connected to a lower end portion thereof. The stapler driving motor M2 is supported with a motor supporting plate M2*a*. A motor supporting shaft M2*b* is connected between a right end portion of the motor supporting plate M2*a* and the shaft supporting portion 71*a*. Therefore, stapler driving motor M2 is constructed to integrally move with the moving wheel 71.

Therefore, by normally or reversely rotating the stapler driving motor M2, the guide gear 73 rotates, and the moving wheel 71 moves in a forward and backward direction along the stapler guide member 62 by the gear teeth 62*b* of stapler guide groove 62*a* engaged with the guide gear 73. In addition, the stapler driving motor M2 according to the first embodiment is constructed with a stepping motor which is driven to rotate at a predetermined angle in response to input of a pulse. In addition, the stapler driving motor M2 according to the first embodiment is set to move the moving wheel 71 in a forward and backward direction with a moving speed of 31.5 cm/s. Therefore, the moving wheel 71 according to the first embodiment is set to pass from a front end to a rear end of the staple position light-shielding portion 63 in 40 ms and to pass the groove position light-shielding portion 64 in 50 ms or more. In addition, at a time of performing staple, the moving wheel 71 is moved to the staple position with reference to the groove position which is a reference position for a moving start.

In FIG. 4, a stapler position detection sensor SN1 is fixed and supported on a lower surface of the moving wheel 71. The stapler position detection sensor SN1 is constructed with a light-emitting portion 74*a* for emitting light and a photosensor having a light-receiving portion 74*b* for receiving the light emitted from the light-emitting portion. When the moving wheel 71 is moved to the staple position or the groove position, the stapler position detection sensor SN1 is disposed at a position which is shield by the staple position light-shielding portion 63 or the groove position light-shielding portion 64 being inserted between a light-emitting portion 74*a* and a light-receiving portion 74*b*. Therefore, the stapler position detection sensor SN1 and the moving wheel 71 can move between the staple position (side end binding position, that is, a position indicted by a solid line or a dash-dot-dot line of FIG. 5) and the groove position (reference position and the corner binding position, that is, a position indicated by a dash-dot line of FIG. 5) by the stapler position light-shielding portion 63 and the groove position light-shielding portion 64.

A stapler main body 76 is supported on an upper surface of the moving wheel 71. The stapler main body 76 comprises an acupuncture beating portion 76*a* for beading out a staple acupuncture 77 for binding the recording sheet bundle mounted on the end binding compile tray 7 and an acupuncture bending portion 76*b* for bending an end portion of the staple acupuncture beaten from the acupuncture beating portion 76*a*. The acupuncture beating portion 76*a* is supported in a rotatable manner to the acupuncture bending portion 76*b* with the rotating shaft 76*c*. In addition, the front end portion 78*a* of the stapler operating member 78 is connected to the acupuncture beating portion 76*a* with a pin. An eccentric cam 79 rotatably supported to the acupuncture bending portion 76*b* is slightly inserted into a ring-shaped rear end portion 78*b* of the stapler operating member 78. Therefore, by rotating the eccentric cam 79 with a driving apparatus (not shown), the stapler operating member 78 moves in an upward and downward direction, and the acupuncture beating portion 72*a* moves in an upward and downward direction, so that the staple work is performed.

The moving staple member 70 is constructed with elements denoted by the reference numerals 71 to 79.

(Description of Ejecting Roll, Shelf, and Set Clamp Paddle)

Figure 10:
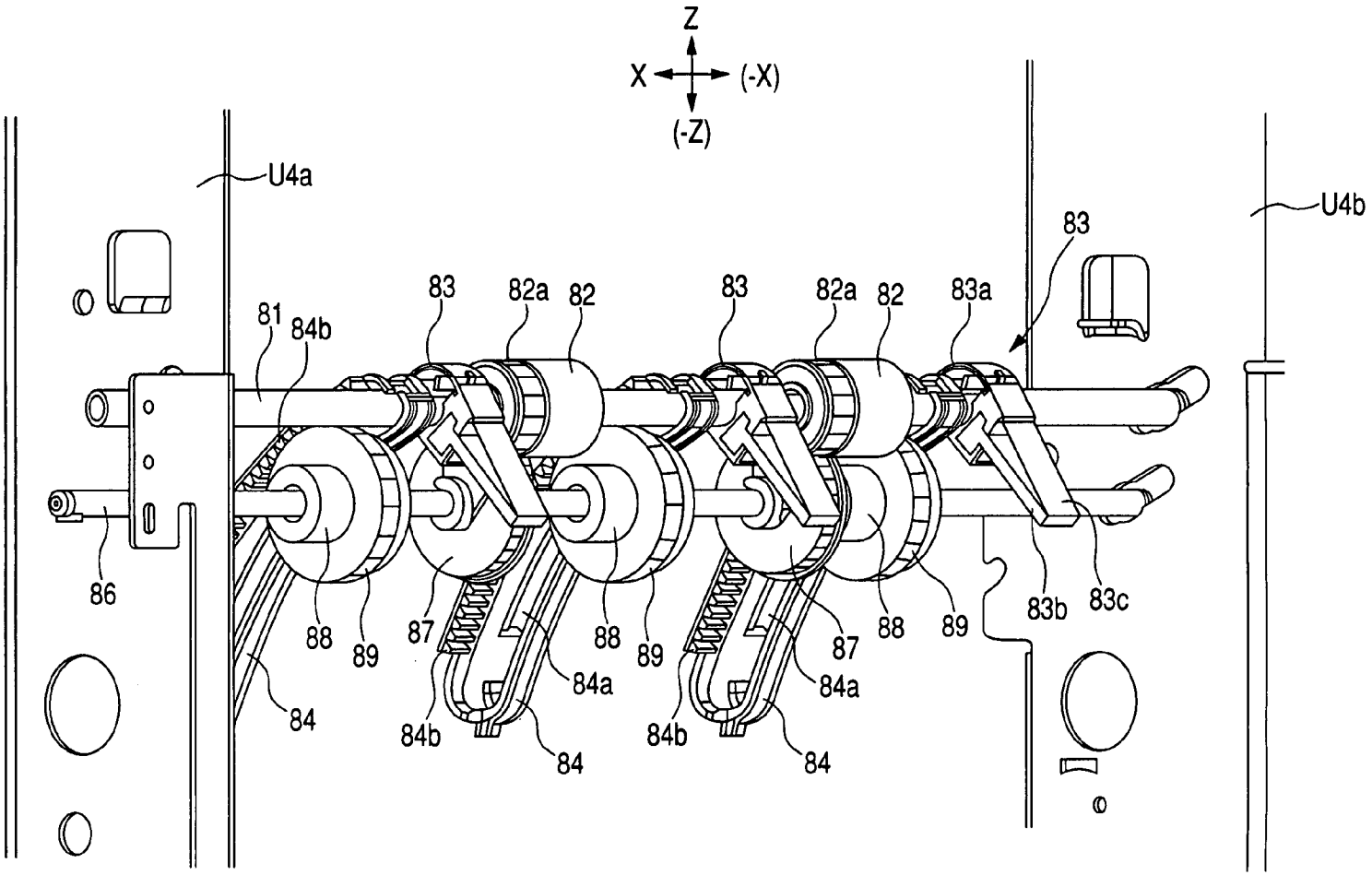
FIG. 10 is a perspective view for explaining an ejecting roll portion of the end binding compile tray.

FIG. 10 is a perspective view for explaining an ejecting roll portion of the end binding compile tray.

Figure 11A:
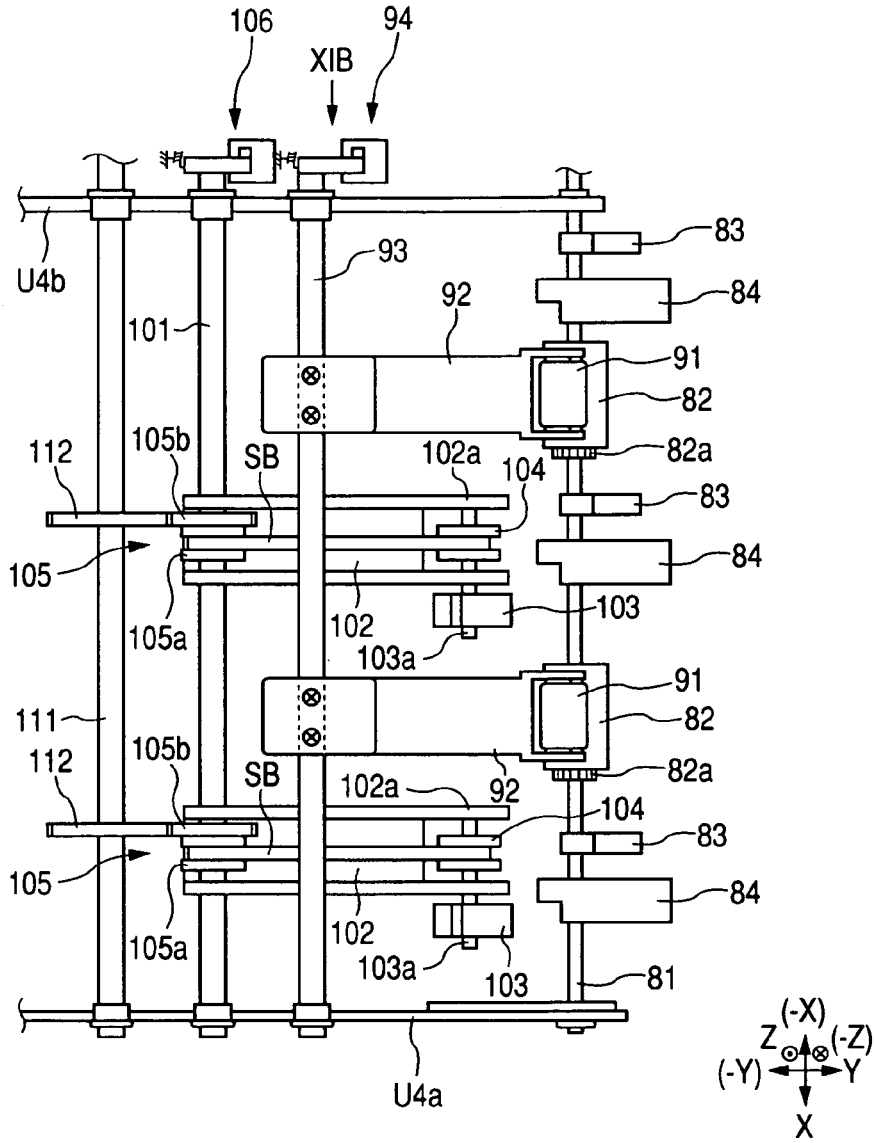
FIGS. 11A and 11B are views for explaining a clamp roll and a sub paddle.
Figure 11B:
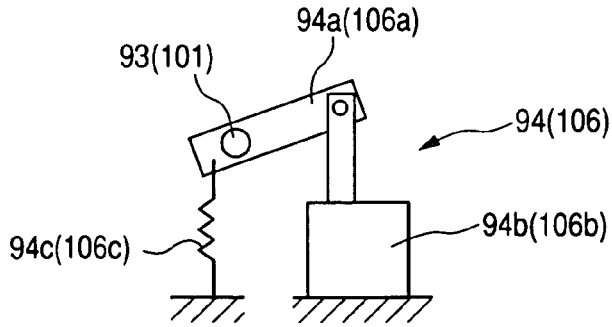

FIGS. 11A and 11B are views for explaining a clamp roll and a sub paddle, FIG. 11A is a plan view, and FIG. 11B is view seen from a direction of arrow XIB of FIG. 11A.

In FIGS. 2, 3, 10, 11A and 11B, the ejecting roll shaft 81 is disposed in a rotatable manner between two front and rear frames U4*a* and U4*b* of the sheet post-processing apparatus U4 at a front portion in a sheet ejecting direction of the end binding compile tray 7. A driving force is transmitted from a normally or reversely rotatable sheet ejecting motor through an electromagnetic clutch (not shown) to the ejecting roll shaft 81, and the ejecting roll shaft 81 rotates by on and off of the electromagnetic clutch.

In FIGS. 10, 11A and 11B, two ejecting rolls 82 are supported in a rotatable manner with a predetermined interval in a forward and backward direction to the ejecting roll shaft 81, and each of the ejecting rolls 82 has a roll gear 82*a*.

In addition, three set clamp paddles 83 disposed with a predetermined interval are fixed and supported to the ejecting roll shaft 81. The set clamp paddle 83 comprises a cylindrical core portion 83*a*, an elastically-deformable sheet pressing portion 83*b* fixed and supported to the core portion 83*a*, and a low friction film (a low friction member) 83*c* fixed and supported to the core portion 83*a* to reduce a friction to the recording sheet.

In addition, three shelves (sheet lower surface supporting member) 84 disposed with a predetermined interval are provided to the ejecting roll shaft 81. The shelves 84 extend in a sheet ejecting direction and are provided with a guided long hole 84 which the ejecting roll shaft 81 passes through. In addition, rack teeth 84*b* (see FIG. 10) extending in the sheet ejecting direction are formed to the shelves 84.

In FIG. 10, a driving shaft 86 to which the driving force is transmitted from the sheet ejecting motor (not shown) is disposed under the ejecting roll shaft 81. An ejecting roll driving gear 87 engaged with the roll gear 82*a* of the ejecting roll 82 is fixed and supported to the driving shaft 86. In addition, a shelf operating gear 89 having a torque limiter 88 and engaged with the rack teeth 84*b* of the shelves 84 is fixed and supported to the driving shaft 86. Therefore, by the normal or reverse rotation of the sheet ejecting motor, the ejecting roll 82 normally or reversely rotates, and the shelves 84 are guided to the ejecting roll shaft 81 to move between the sheet lower surface supporting position shown in FIG. 2 and a receiving position shown in FIG. 3. In addition, in a state that the shelves 84 move to the sheet lower surface supporting position or the receiving position, or in a case where a rotation for moving the shelves 84 forwardly or backwardly is transmitted from the driving shaft 86, the driving shaft 86 idles with respect to the shelf operating gear 89 by the torque limiter 88.

The set clamp paddle 83 rotates according to the rotation of the ejecting roll shaft 81 by on and off of the electromagnetic clutch and moves between a stacker sheet clamp position (see FIG. 2) for suppressing the sheet bundle while contacting with an upper surface of the sheet bundle on a stacker tray TH1 and a sheet lower surface supporting position (see FIG. 3) for supporting a lower surface of the recording sheet ejected on the end binding compile tray 7 in a state that the shelves 84 are maintained in the receiving position.

(Description of Clamp Roller)

In FIGS. 2, 11A and 11B, a clamp roller 91 is disposed over the ejecting roll 82. The clamp roller 91 is supported in a rotatable manner by a plate-spring-shaped clamp roller supporting member 92. A left end portion of the clamp roller supporting member 92 is fixed and supported to a clamp roller lifting shaft 93 which is supported in a rotatable manner to the frames U4*a* and U4*b*. A clamp roller lifting element 94 is disposed at a rear end of the clamp roller lifting shaft 93. The clamp roller lifting element 94 comprises a lifting bar 94*a* connected to the clamp roller lifting shaft 93, a clamp roller lifting solenoid 94*b* connected to a right end portion of the lifting bar 94*a* , and an extension spring 94*c* connected to a left end portion of the lifting bar 94*a*.

Therefore, in a case where the clamp roller lifting solenoid 94*b* is in an off state, the clamp roller 91 is maintained in an upper standby position (see a solid line of FIG. 2) by the extension spring 94*c*. On the other hand, in a case where the clamp roller lifting solenoid 94*b* is in an on state, the clamp roller 91 is maintained in a lower clamp position (see a dotted line of FIG. 2) to interpose the recording sheet or the recording sheet bundle on the end binding compile tray 7 by the ejecting roll 82 and the clamp roller 91. At this time, the recording sheet is interposed with a suitable pressure by the plate-spring-shaped clamp roller supporting member 92, so that the interposed recording sheet or recording sheet bundle can be drawn into the end binding compile tray 7 or ejected from the end binding compile tray 7 according to the normal or reverse rotation of the ejecting roll 82.

In addition, the clamp roller lifting element 94 is not limited to the solenoid 94*b* or the spring 94*c*, but a lifting construction formed with a motor or an eccentric cam may be used. In addition, the clamp roller supporting member 92 is not limited to the plate-spring-shaped construction, but a construction having a high-strength clamp roller supporting member and a coil spring for pressing the clamp roller supporting member to the ejecting roll 82 may be used.

(Description of Sub Paddle)

In FIGS. 3, 11A and 11B, a sub paddle supporting shaft 101 is supported in a rotatable manner to the frames U4*a* and U4*b* under a left side of the clamp roller lifting shaft 93. Plural sub paddle supporting members 102 extending in a right direction with a predetermined interval in a forward and backward direction are supported to the sub paddle supporting shaft 101. A sub paddle supporting arm 102*a* is formed in a right end portion of the sub paddle supporting member 102. A sub paddle supporting arm 102*a* is constructed with the same structure as the main paddle 47, so that a sub paddle (second sheet end alignment member) 103 for carrying the recording sheet on the end binding compile tray 7 to the main paddle 47 is supported in a rotatable manner. A pulley is supported to the rotating shaft 103*a* of the sub paddle 103. A driving side pulley 105 is supported in a rotatable manner at a position corresponding to the pulley 104 in the sub paddle supporting shaft 101. The driving side pulley 105 has a pulley unit 105*a* and a gear unit 105*b*, and a sub paddle driving belt SB is mounted between the pulley 104 and the pulley unit 105*a*.

A sub paddle lifting element 106 constructed with the same structure as the clamp roller lifting element 94 is disposed to a rear end of the sub paddle supporting shaft 101. Namely, the sub paddle lifting member 106 comprises a lifting bar 106*a*, a sub paddle lifting solenoid 106*b*, and an extension spring 106*c*. Therefore, by on and off of the sub paddle lifting solenoid 106*b*, the sub paddle 103 moves between the upper standby position (see a solid line of FIG. 3) and the lower sheet inserting position (see a dotted line of FIG. 3) for drawing the recording sheet into the main paddle 47.

In FIGS. 11A and 11B, a sub paddle driving shaft 111 is supported in a rotatable manner to the frames U4*a* and U4*b* in a left side of the sub paddle supporting shaft 101. A driving gear 112 engaged to the gear unit 105*b* of each driving side pulley 105 is fixed and supported to the sub paddle driving shaft 111. A rotation is transmitted to the sub paddle driving shaft 111 from a post-processing apparatus sheet carrying roll driving motor (not shown) for driving the compile tray ejecting roll 6, and the rotation is transmitted through a driving gear 112, a gear unit 105*b*, a pulley unit 105*a*, a sub paddle driving belt SB, and a pulley 104 according to the driving of the post-processing apparatus sheet carrying roll driving motor, so that the sub paddle 103 can rotate.

In addition, although the sub paddle supporting shaft 101 and the clamp roller supporting shaft 93 are individually disposed in the sheet post-processing apparatus U4 according to the first embodiment, a construction where the sub paddle supporting member 102 or the driving side pulley 105 is supported in a rotatable manner to the clamp roller supporting shaft 93 and extends in a forward and backward direction, and a lifting bar integrally movable with plural sub paddle supporting member 102, a sub paddle lifting solenoid connected to the lifting bar, and an extension spring are provided may be employed, and the sub paddle supporting shaft 101 may be omitted.

(Description of Stacker Tray)

In FIGS. 2 and 3, a stacker tray (end binding ejecting tray) TH1 for receiving an alignment sheet bundle ejected from the end binding compile tray 7 by the ejecting roller 82 or an end-binding sheet bundle is disposed to protrude outwardly in a right side wall of the sheet processing unit U4. The stacker tray TH1 comprises a tray guide 121 supported to a right side surface of the sheet processing unit U4, a slider 122 supported in a slide-able manner in a forward and backward direction to the tray guide 121, and a stacker tray main body 123 connected with a screw to the slider 122. In addition, the slider 122 and the stacker tray main body 123 may be constructed in an upward and downward movable manner by a conventional lifting mechanism (not shown) (for example, lifting mechanisms disclosed in JP-A-07-49082 and JP-A-07-300270). Alternatively, the slider 122 and the stacker tray main body 123 may be constructed in an upward and downward movable manner by a height sensor (not shown) according to an amount (a height of an upper surface of the sheet bundle) of recording sheet bundle on the stacker tray main body 123 (for example, see JP-A-2003-089463).

(Description of Saddle Stitching Apparatus)

In FIGS. 2 and 3, a saddle stitching apparatus NTS for aligning the recording sheet bundle, binding a sheet carrying directional center position thereof, and ejecting the recording sheet bundle with the center portion folded to the saddle stitching ejecting tray TH2 is disposed in a lower portion the saddle stitching ejecting path SH8. The saddle stitching apparatus NTS may employ various conventional constructions (for example, see JP-A-2003-089462 and JP-A-2003-089463), and thus, detailed description thereof will be omitted.

Description of Control Unit of First Embodiment

Figure 12:
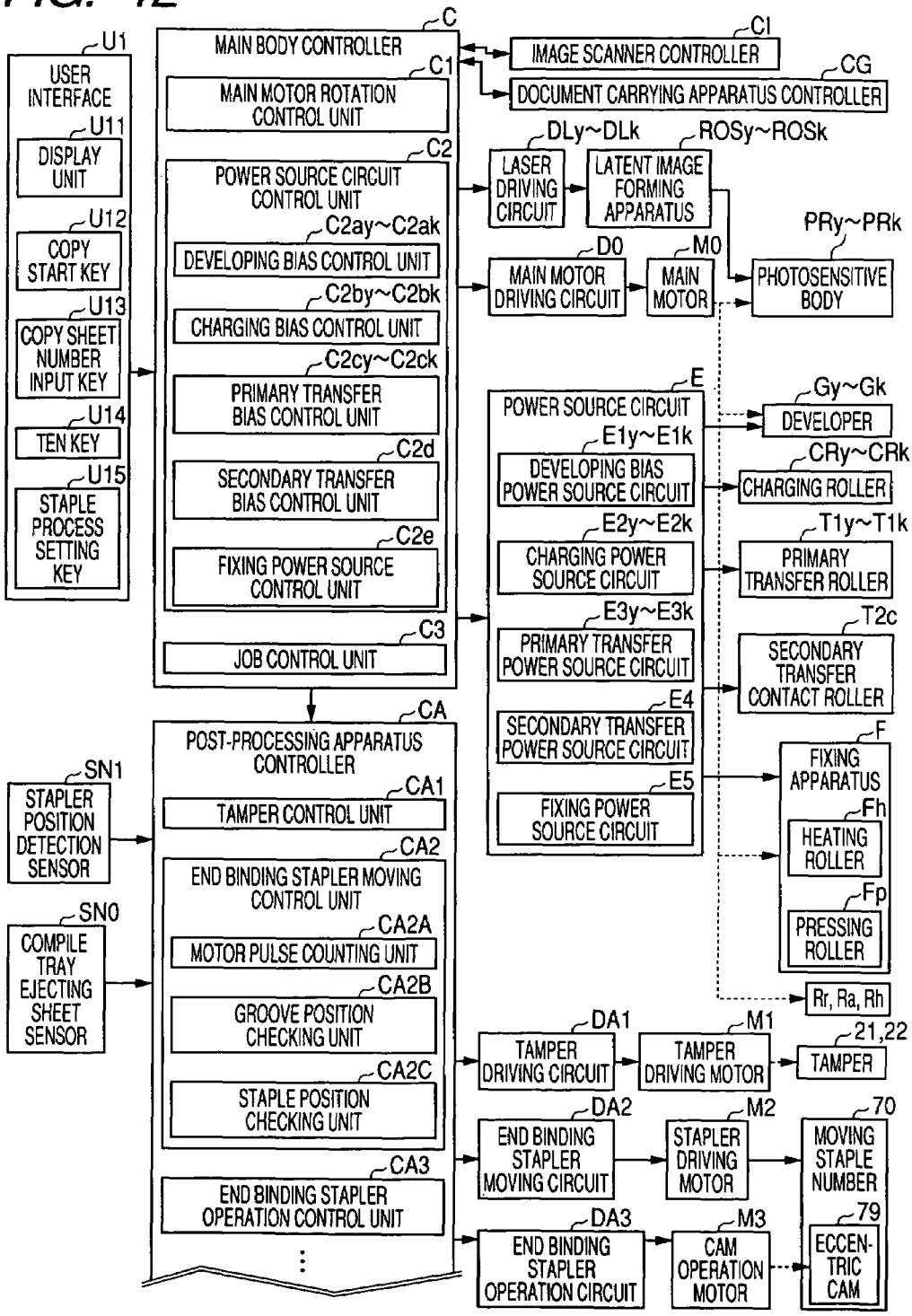
FIG. 12 is a block diagram (functional block diagram) showing functions of a control unit of an image forming apparatus according to the first embodiment.

FIG. 12 is a block diagram (functional block diagram) showing functions of a control unit of an image forming apparatus according to the first embodiment.

Figure 13:
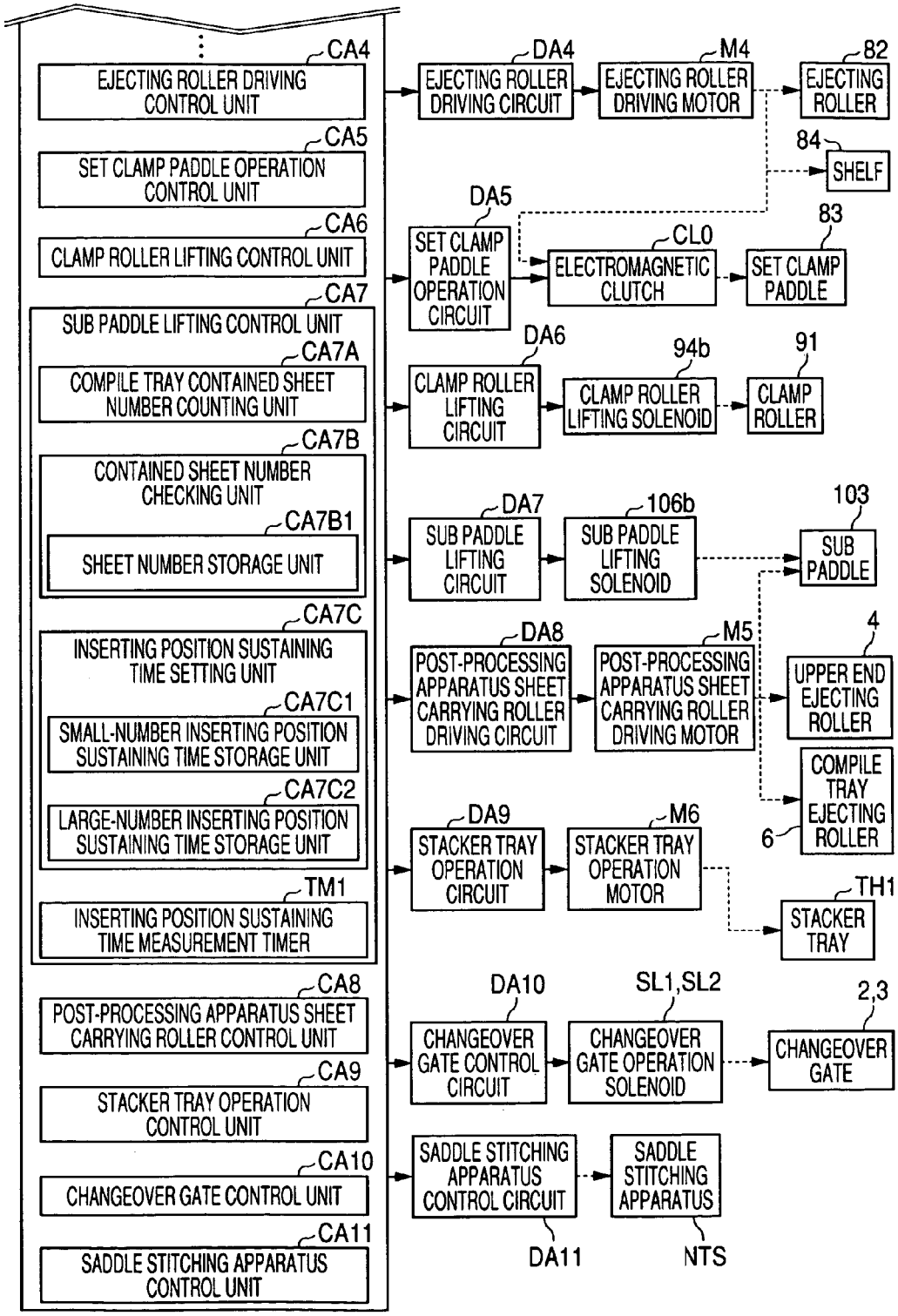
FIG. 13 is a block diagram following FIG. 12.

FIG. 13 is a block diagram following FIG. 12.

In FIGS. 12 and 13, a main body controller C is constructed with a microcomputer having an I/O (input/output interface) for inputting/outputting signals from/to external units and adjusting levels of input and output signals, a ROM (read only memory) for storing programs or data required for performing necessary processes, a CPU (central process unit) for performing processes according to the programs stored in the ROM, and a clock oscillator and can implement various functions by executing the programs stored in the ROM.

(Signal Input Elements Connected to Main Body Controller C)

Output signals of the following signal output elements UI are input to the main body controller C.

UI: User Interface

The user interface UI comprises a display unit UI1, a copy start key UI2, a copy sheet number input key UI3, a numeral key UI4, and a staple process setting key UI5 for setting executed staple process saddle stitching, corner binding, side end binding, no binding.

(Controlled Elements Connected to Main Body Controller C)

The main body controller C outputs the following control signal of the controlled element.

CI: Image Scanner Controller

The image scanner controller CI is the controller which is mounted in the image scanner of the image input unit U1 having the automatic document carrying apparatus and the image scanner, and controls the operation of the image scanner according to the control signal output from the main body controller C of the image forming apparatus main body U3.

CG: Document Carrying Apparatus Controller

The document carrying apparatus controller CG is the controller which is mounted in the automatic document carrying apparatus (not shown) of the image input unit U1 having the automatic document carrying apparatus and image scanner, and controls the operation of automatic document carrying apparatus according to the control signal output from the main body controller C of the image forming apparatus main body U3.

DLy~DLk: Laser Driving Circuit

The laser driving circuit DL drives the laser diode (not shown) of the ROS (latent image forming apparatus) to form the electrostatic latent image on the surfaces of the photosensitive bodies PRy to PRk.

D0: Main Motor Driving Circuit

The main motor driving circuit D0 drives the main motor M0 to rotate the developing roll (not shown) and the heating roll Fh of the developers Gy to Gk and the image carrying body through a gear (not shown).

E: Power Source Circuit

The power source circuit E has the following power source circuit.

Ely to Elk: Developing Bias Power Source Circuit

The developing bias power source circuit Ely to Elk applies the developing bias to the developing roll Ga (not shown) of the developer Gy to Gk.

E2*y* to E2*k*: Charging Power Source Circuit

The charging power source circuit E2*y* to E2*k* applies the charge bias to the charging roll CRy to CRk.

E3*y* to E3*k*: Primary Transfer Power Source Circuit

The primary transfer power source circuit E3*y* to E3*k* applies the primary transfer bias to the primary transfer roll Tly to Tlk.

E4; Secondary Transfer Power Source Circuit

The secondary transfer power source circuit E4 applies the secondary transfer bias to the secondary transfer contact roll T2*c*.

E5: Fixing Power Source Circuit

The fixing power source circuit E5 supplies the heating power to the heating roll Fh.

CA: Post-Processing Apparatus Controller

The post-processing apparatus controller CA is the controller which is mounted in the finisher sheet post-processing apparatus U4 and controls the operation of the finisher U4 according to the control signal output from the main body controller of the image forming apparatus main body U3.

(Signal Input Elements Connected to Post-Processing Apparatus Controller CA)

The post-processing apparatus controller CA is input with the following output signal of the signal input element.

SN0: Compile Tray Ejecting Sheet Sensor

The compile tray ejecting sheet sensor SN0 detects the existence of the recording sheet on the end binding ejecting path SH7.

SN1: Stapler Position Detection Sensor

The stapler position detection sensor SN1 detects whether the light is shield (ON) by the staple position light-shielding portion 63 or the groove position light-shielding portion 64.

(Driven Elements Connected to Post-Processing Apparatus Controller CA)

DA1: Tamper Driving Circuit

The tamper driving circuit DA1 controls the forward and backward rotation of the tamper driving motor M1 to operate the tampers 21 and 22.

DA2: End Binding Stapler Moving Circuit

The end binding stapler moving circuit DA2 controls the forward and backward rotation of the stapler driving motor M2 to move the wheel 71 and the stapler main body 76.

DA3: End Binding Stapler Operation Circuit

The end binding stapler operation circuit DA3 controls cam operation motor M3, rotates the eccentric cam 79, pulls out the staple acupuncture 77 from the acupuncture beating portion 76*a* to bind the sheet bundle.

DA4: Ejecting Roll Driving Circuit

The ejecting roll driving circuit DA4 controls the forward and backward rotation of the ejecting roll driving motor M4 to rotate the ejecting roll 82 forwardly or backwardly or move the shelves 84 between the receiving position (See FIG. 3) and the sheet lower surface supporting position (See FIG. 2).

DA5: Set Clamp Paddle Operation Circuit

The set clamp paddle operation circuit DA5 controls the ON/OFF of the electromagnetic clutch CL0 to move the set clamp paddle 83 between the stacker sheet clamp position (See FIG. 2) and the sheet lower surface supporting position (See FIG. 3).

DA6: Clamp Roll Lifting Circuit

The clamp roll lifting circuit DA6 controls the ON/OFF of the clamp roller lifting solenoid 94*b* to move the clamp roll 91 between the standby position and the clamp position.

DA7: Sub Paddle Lifting Circuit

The sub paddle lifting circuit DA7 controls the ON/OFF of the sub paddle lifting solenoid 106*b* to move the sub paddle 103 between the standby position and the sheet inserting position.

DA8: Post-Processing Apparatus Sheet Carrying Roller Driving Circuit

The post-processing apparatus sheet carrying roller driving circuit DAB controls the post-processing apparatus sheet carrying roll driving motor M5 to drive the sheet carrying roll such as the upper end ejecting roll 4 or the compile tray ejecting roll 6.

DA9: Stacker Tray Operation Circuit

The stacker tray operation circuit DA9 controls the stacker tray operation motor M6 to vertically move the stacker tray TH1.

DA10: Changeover Gate Control Circuit

The changeover gate control circuit DA10 controls changeover gate operation solenoids SL1 and SL2 to move changeover gates 2 and 3.

DA11; Saddle stitching Apparatus Control Circuit

The saddle stitching apparatus control circuit DA11 controls the control apparatus such as the stapler of the saddle stitching apparatus NTS to perform the saddle stitching of the recording sheet bundle.

(Functions of Main Body Controller C)

The main body controller C a program function realizing unit (function realizing unit) which executes the process according to the output signal from each signal output element and outputs the control signal to each control element. The program function realizing unit (function realizing unit) for realizing various functions of the main body controller C will be described below.

C1: Main Motor Rotation Control Unit

The main motor rotation control unit C1 controls the main motor driving circuit D1 to control the rotation such as the photosensitive bodies PRy to PRk, the developing roll Ga of the developer G, and the fixing apparatus F.

C2: Power Source Circuit Control Unit

The power source circuit control unit C2 has the following unit C2*a* to C2*d*, and controls the power source circuit E to control the developing bias, the charging bias, the transfer bias, the ON/OFF of the heater of the heating roll Fh.

C2*ay* to C2*ak:* Developing Bias Control Unit

The developing bias control unit C2*ak* to C2 controls the operation of the developing bias power source circuits Ely~Elk to control the developing bias applied to the developing roll Ga of the developer Gy to Gk.

C2*by* to C2*bk:* Charging Bias Control Unit

The charging bias control unit C2*by* to C2*bk* controls the operation of the charging bias power source circuit E2*y* to E2*k* to control the charging bias applied to each of the charging rolls CRy to CRk.

C2*cy* to C2*ck:* Primary Transfer Bias Control Unit

The primary transfer bias control unit C2*cy* to C2*ck* controls the operation of the transfer power source circuit E3*y* to E3*k* to control the transfer bias of the primary transfer roll Tly to Tlk.

C2*d:* Secondary Transfer Bias Control Unit

The secondary transfer bias control unit C2*d* controls the operation of the transfer power source circuit E4 to control the transfer bias applied to the secondary transfer contact roll T2*c*.

C2*e;* Fixing Power Source Control Unit

The fixing power source control unit C2*e* controls the operation of the fixing power source circuit E5 to controls the ON/OFF of the heater of the heating roll Fh.

C3: Job Control Unit

The job control unit C3 controls the operation of the ROS, the image carrying bodies PRy to PRk, the transfer rolls Tly~Tlk and T2*c*, and the fixing apparatus F according to the input of the copy start key UI2 to execute the job printing operation and the copy operation which are the image recording operations.

(Function of Post-Processing Apparatus Controller CA)

CA1: Tamper Control Unit

The tamper control unit CA1 controls the tamper driving circuit DA1 according to the size of the recording sheet received in the end binding compile tray 7 to operate the tampers 21 and 22 and align the side edge of the recording sheet received in the end binding compile tray 7.

CA2: End Binding Stapler Moving Control Unit

The end binding stapler moving control unit CA2 has a motor pulse counting unit CA2A, a groove position checking unit CA2B, and a staple position checking unit CA2C and controls the end binding stapler moving circuit DA2 to move the moving staple member 70 to the groove position or the staple position, according to the user input of the staple process setting key UI5 of user interface UI.

CA2A; Motor Pulse Counting Unit

The motor pulse counting unit CA2A counts the pulse number m of the motor driving pulse input to the stapler driving motor M2 composed of the stepping motor.

CA2B: Groove Position Checking Unit

The groove position checking unit CA2B checks whether the moving staple member 70 moves to the groove position, based on the time that the stapler position detection sensor SN1 detects the ON (light-shielding) when the moving staple member 70 moves toward the groove position. The groove position checking unit CA2B according to the first embodiment considers the margin in the time (40 msec) that passes through staple position light-shielding portion 63 and check that the groove position light-shielding portion 64 is detected, that is, moves to the groove position when the stapler position detection sensor SN1 is in the ON state although the time of 50 msec elapses, groove position light-shielding portion 64.

CA2C: Staple Position Checking Unit

The staple position checking unit CA2C checks whether the moving staple member 70 which moved to the groove position moves to the staple position the corner binding or the side end binding. The staple position checking unit CA2C according to the first embodiment checks whether the moving staple member 70 moves to the corner binding position staple position, based on the pulse number m stored in the motor pulse counting unit CA2A and the pulse number corner binding position pulse number m1 that the stapler position detection sensor SN1 detects the groove position light-shielding portion 64 and moves to the corner binding position. In addition, it is checked whether the moving staple member 70 moves to the side end binding position, based on the pulse number m stored in the motor pulse counting unit CA2A and the side end binding position pulse number M2 which is used for checking whether the moving staple member 70 moves to the side end binding position.

CA3: End Binding Stapler Operation Control Unit

The end binding stapler operation control unit CA3 controls the end binding stapler operation circuit DA3, rotates the eccentric cam 79, and pulls out the staple acupuncture from the acupuncture beating portion 76*a* to bind the sheet bundle. When the execution of the staple (staple corner binding or side end binding) is specified by the user input of the staple process setting key UI5 of the user interface (UI), the end binding stapler operation control unit CA3 according to the first embodiment moves to the staple position and staples the recording sheet bundle loaded in the end binding compiler tray 7.

CA4: Ejecting Roll Driving Control Unit

The ejecting roll driving control unit CA4 controls the ejecting roll driving circuit DA4, and rotates the ejecting roll 82 forwardly or backwardly to eject the recording sheet to the stacker tray TH1, pull the recording sheet to the compile tray 7, or move the shelves 84 between the receiving position and the sheet lower surface supporting position. When the matched or stapled recording sheet bundle is ejected from the end binding compile tray 7 to the stacker tray TH1, the ejecting roll driving control unit CA4 according to the first embodiment forwardly rotates the ejecting roll 82 to eject the sheet bundle and moves the shelves 84 to the receiving position. When the next one recording sheet is pulled to the main paddle 47 after ejecting the recording sheet bundle, the ejecting roll 82 rotates backwardly to pull the recording sheet and moves the shelves 84 to the sheet lower surface supporting position.

CA5: Set Clamp Paddle Operation Control Unit

The set clamp paddle operation control unit CA5 controls the set clamp paddle operation circuit DA5 and moves the set clamp paddle 83 between the stacker sheet clamp position (See FIG. 2) and the sheet lower surface supporting position (See FIG. 3). The set clamp paddle operation control unit CA5 sustains the set clamp paddle 83 in the stacker sheet clamp position under the condition that the shelves 84 moves to the sheet lower surface supporting position. Also, the set clamp paddle 83 moves to the sheet upper surface supporting position at timing that the rear end of the matched or stapled recording sheet bundle which is ejected into the stacker tray TH1 passes through the ejecting roller 82. After ejecting the sheet bundle, the set clamp paddle 83 moves to the stacker sheet clamp position at timing that the next one recording sheet is received in the end binding compile tray 7 and pulled toward the main paddle 47.

CA6: Clamp Roll Lifting Control Unit

The clamp roll lifting control unit CA6 controls the clamp roll lifting circuit DA6 and moves the clamp roll 91 between the standby position and the clamp position according to timing that the matched or stapled (bound) recording sheet bundle is ejected.

CA7: Sub Paddle Lifting Control Unit (Second Sheet End Alignment Member Control Unit)

The sub paddle lifting control unit CA7 has a compile tray contained sheet number counting unit CA7A, a contained sheet number checking unit CA7B, an inserting position sustaining time setting unit CA7C, and an inserting position sustaining time measurement timer TM1. Further, the sub paddle lifting control unit CA7 controls the sub paddle lifting circuit DA7 and moves the sub paddle 103 according to the timing that the recording sheet is received in the end binding compile tray 7 between the standby position and the sheet inserting position, and carries the recording sheet toward the main paddle 47.

CA7A: Compile Tray Contained Sheet Number Counting Unit

The compile tray contained sheet number counting unit CA7A counts the contained sheet number n of the recording sheet contained in the end binding compile tray 7, based on the sheet detection result of the compile tray ejecting sheet sensor SN0.

CA7B: Contained Sheet Number Checking Unit

The contained sheet checking unit CA7B has a storage unit CA7B1 which stores the sheet number for changing the carrying position sustaining time n1 for the changeover of the inserting position sustaining time (carrying position sustaining time) for sustaining the sub paddle 103 in the sheet inserting position and checks whether the contained sheet number n which is counted at the compile tray contained sheet number counting unit CA7A is greater than the sheet number for changing the carrying position sustaining time n1. Also, the sheet number storage unit that stores the sheet number for changing the carrying position sustaining time CA7B1 stores twenty sheets as the sustaining time changeover number n1.

CA7C: Inserting Position Sustaining Time Setting Unit (Carrying Position Sustaining Time Setting Unit)

The inserting position sustaining time setting unit CA7C has a small-number inserting position sustaining time storage unit CA7C1 and a large-number inserting position sustaining time storage unit CA7C2, and sets the inserting position sustaining time (carrying position sustaining time) for sustaining the sub paddle 103 in the sheet inserting position (sheet carrying position), based on the sheet number of the recording sheets contained in the end binding compile tray 7. The inserting position sustaining time setting unit CA7C according to the first embodiment sets any one of the small-number inserting position sustaining time t1 (described later) or the large-number inserting position sustaining time t2 (described later), based on the checking result of the contained sheet number checking unit CA7B.

CA7C1: Small-number Inserting Position Sustaining Time Storage Unit (Carrying Position Sustaining Time Storage Unit)

The small-number inserting position sustaining time storage unit CA7C1 stores the small-number inserting position sustaining time t1 which is the inserting position sustaining time when the sheet number of the recording sheets contained (loaded) in the end binding compile tray 7 is small. The small-number inserting position sustaining time storage unit CA7C1 according to the first embodiment stores the time (430 msec) that the recording sheet received in the end binding compile tray 7 is pulled (carried) toward the rear end position determination wall 41*a* by the sub paddle 103 and the sheet ejecting directional rear end (sheet inserting directional front end) contacts with the rear end position determination wall 41*a* as the small-number inserting position sustaining time (small-number sustain time) t1.

CA7C2: Large-number Inserting Position Sustaining Time Storage Unit (Carrying Position sustaining Time Storage Unit)

The large-number inserting position sustaining time storage unit CA7C2 stores the large-number inserting position sustaining time (large-number sustaining time) t2 which is the inserting position sustaining time when the sheet number of the recording sheets contained (loaded) in the end binding compile tray 7 is large. The large-number inserting position sustaining time storage unit CA7C2 according to the first embodiment stores the time shorter than the small-number inserting position sustaining time t1 as the large-number inserting position sustaining time t2 and the time (350 msec) that the recording sheet received in the end binding compile tray 7 is pulled (carried) toward the rear end position determination wall 41*a* by the sub paddle 103 and the sheet ejecting directional rear end (sheet inserting directional front end) is carried to a position which can be inserted by the main paddle 47.

TM1: Inserting Position Sustaining Time Measurement Timer

The inserting position sustaining time measurement timer TM1 measures inserting position sustaining times t1 and t2 set by the inserting position sustaining time setting unit CA7C. The inserting position sustaining time measurement timer TM1 according to the first embodiment is set to any one of the small-number inserting position sustaining time t1 or the large-number inserting position sustaining time t2 and the time increases if the set time elapses.

CA8: Post-Processing Apparatus Sheet Carrying Roller Control Unit

The post-processing apparatus sheet carrying roller control unit CA8 controls the post-processing apparatus sheet carrying roller driving circuit DA8 and carries the recording sheet at timing that the sheet is received in the post-processing apparatus U4.

CA9: Stacker Tray Operation Control Unit

The stacker tray operation control unit CA9 controls the stacker tray operation circuit DA9 and vertically moves the stacker tray TH1 according to the amount of the recording sheets contained in the stacker tray TH1.

CA10: Changeover Gate Control Unit

The changeover gate control unit CA10 controls the changeover gates 2 and 3 so that the recording sheet S received from the sheet receiving opening 1 is carried to any one of the upper end ejecting path SH6, the end binding ejecting path SH7, and the saddle stitching ejecting path SH8 according to the user input of staple process setting key UI5 of the user interface UI.

CA11: Saddle Stitching Apparatus Control Unit

The saddle stitching apparatus control unit CA11 controls the saddle stitching apparatus control circuit DA11 and binds the intermediate of the recording sheet bundle by the saddle stitching apparatus NTS, when the saddle stitching is specified by the user input of the staple process setting key UI5 of the user interface UI.

Description of Flowchart of First Embodiment (Description of Flowchart of Sub Paddle Lifting Process)

Figure 14:
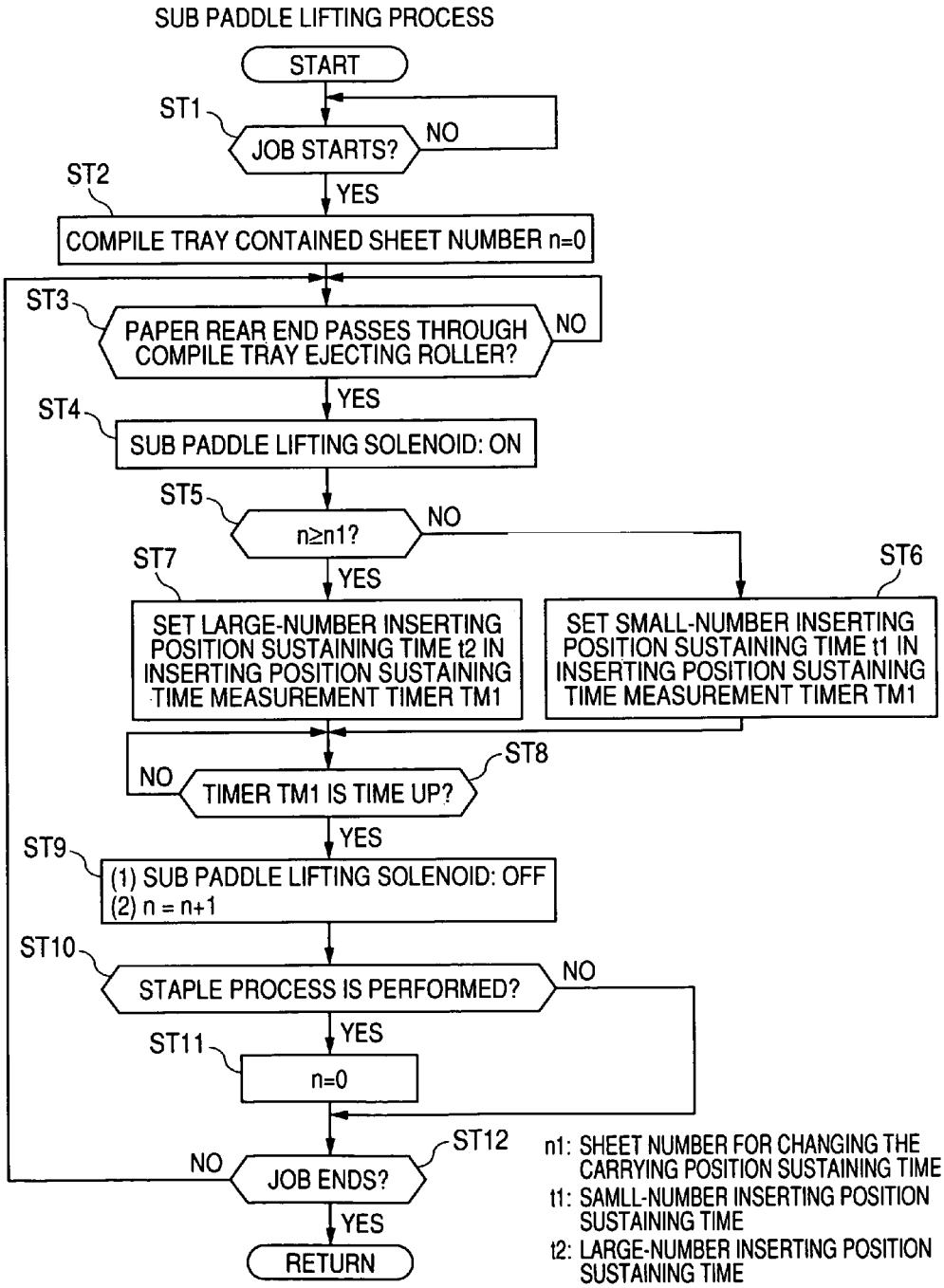
FIG. 14 is a flowchart of a sub paddle lifting process of a post-processing apparatus according to the first embodiment.

FIG. 14 is a flowchart of the sub paddle lifting process of the post-processing apparatus according to the first embodiment.

Each step (ST) of the flowchart of FIG. 14 is performed according to a program stored in a hard disk or a ROM of the controller C. Also, this process is executed in parallel with the other various processes of the image forming apparatus.

The flowchart shown in FIG. 14 starts by turning on a power supply source of the image forming apparatus U.

In a step ST1 of the FIG. 14, it is checked whether the copy start key UI2 is turned on and the image forming operating job starts. If so not, the step ST1 repeats, and, if so, the process proceeds to a step ST2.

In the step ST2, the compile tray contained sheet number n is initialized (reset) to 0. Then, the process proceeds to a step ST3.

In the step ST3, it is checked whether the rear end of the recording sheet passes through the compile tray ejecting roller 6, based on the detection signal of the compile tray ejecting sheet sensor SN0. If so not, the step ST3 repeats, and, if so, the process proceeds to a step ST4.

In the step ST4, the sub paddle lifting solenoid 106*b* is turned on and the sub paddle 103 drops to sheet inserting position. Also, in the sheet post-processing apparatus U4 according to the first embodiment, since the sub paddle 103 rotates by the post-processing apparatus sheet carrying roller driving motor M5, the sub paddle 103 rotates in the sheet inserting position or the standby position when the post-processing apparatus sheet carrying roller driving motor M5 is driven. Then, the process proceeds to a step ST5.

In the step ST5, it is checked whether the compile tray contained sheet number n is greater than the sheet number for changing the carrying position sustaining time n1. If so not, the process proceeds to a step ST6, and, if so, the process proceeds to a step ST7.

In the step ST6, the small-number inserting position sustaining time t1 (430 ms) is set in the inserting position sustaining time measurement timer TM1 as the inserting position sustaining time. Then, the process proceeds to a step ST8.

In the step ST7, the large-number inserting position sustaining time t2 (350 ms) is set in the inserting position sustaining time measurement timer TM1 as the inserting position sustaining time. The process proceeds to the step ST8.

In the step ST8, it is checked whether the time of the inserting position sustaining time measurement timer TM1 increases. If so not, the step ST8 repeats and, if so, the process proceeds to a step ST9.

In the step ST9, the following processes 1 and 2 are executed and the process proceeds to a step ST10.

(1) The sub paddle lifting solenoid 106*b* is turned off and the sub paddle 103 is lifted to the standby position.

(2) One is added to the compile tray contained sheet number n. That is, n=n+1.

In the step ST10, the staple process is executed and it is checked whether the recording sheet bundle is ejected from the end binding compile tray 7 to the stacker tray TH1. If so, the process proceeds to a step ST11, and, if so not, the process proceeds to a step ST12.

In the step ST11, the compile tray contained sheet number n is set to 0. The process proceeds to a step ST12.

In the ST12, it is checked whether the job is finished. If so not, the process is returned to the step ST3, and, if so, the process is returned to the step ST1.

Operation of First Embodiment

In the sheet post-processing apparatus U4 according to the first embodiment having the above-referenced construction, when the recording sheet S is received in the end binding compile tray 7, the sub paddle 103 drops to the sheet inserting position (sheet carrying position) and the recording sheet S is carried (pulled) toward the rear end position determination wall 41*a*.

When the sheet number of the recording sheets contained in the end binding compile tray 7 is small (at most 20 sheets), the sheet is carried until the sheet ejecting directional rear end of the recording sheet S contacts with the rear end position determination wall 41*a* by the sub paddle 103 and the main paddle 47, and then sub paddle 103 moves to the standby position. On the other hand, when the sheet number of the recording sheets contained in the end binding compile tray 7 is large (at least 21 sheets), the sheet ejecting directional rear end (sheet inserting directional front end) of the recording sheet S pulled by the sub paddle 103 is carried to the position which can be carried by the main paddle 47 and then the sub paddle 3 moves to the standby position. Thereafter, the recording sheet S is pulled only by the main paddle 47 and carried until the sheet ejecting directional rear end of the recording sheet S contacts with the rear position determination wall 41*a*.

Accordingly, in the post-processing apparatus U4 according to the first embodiment, when pulling the recording sheet, the time that the sub paddle 103 moves to the sheet inserting position and contacts with the recording sheet is changed according to the contained number of the recording sheets contained in the end binding compile tray 7. Further, when the contained sheet number is small, the interval between the recording sheet and the sub paddle 103 is large. Accordingly, the carrying force due to the sub paddle 103 is not large, and thus side edge alignment of the tampers 21 and 22 can be surely performed. Also, when the recording sheet S is pulled from the sub paddle 103 and the main paddle 47, the recording sheet can be suppressed from buckling.

When the contained sheet number of the end binding compile tray 7 is large, since the interval between the recording sheet and the sub paddle 103 is narrow and the flexible sheet contact portion is elastically deformed, the carrying force may too increase. However, when the sheet ejecting directional rear end of the recording sheet is ejected to the position of the main paddle 47, the sub paddle 103 moves to the standby position and thus the sub paddle 103 having large carrying force and the recording sheet do not contact with each other.

As the result, the large force of the sub paddle 103 becomes is the resistance when the side edges of the tampers 21 and 22 are aligned and thus the side edge alignment can be adequately executed. Also, the recording sheet 103 can be suppressed from buckling by the large carrying force of the sub paddle 103.

INDUSTRIAL AVAILABILITY

Modified Example

As mentioned above, although the embodiment of the invention is described in detail, the invention is not limited to the embodiment and may be modified in the scope of the invention described in claims. The modified examples H01 to H09 of the invention will be described below.

(H01) The invention is not limited to the copier and may be applied to the post-processing apparatus of the image forming apparatus such as a printer, a FAX, and a multi-function apparatus (H02) The embodiment is not limited to the end binding apparatus and may be applied to a saddle stitching apparatus.

(H03) In the embodiment, the concrete value of the small-number inserting position sustaining time t1 or the large-number inserting position sustaining time t2 may be adequately changed according to the design or the construction of the length of the compile tray or the sheet inserting speed.

(H04) In the embodiment, the sub paddle 103 is used as the second sheet end alignment member. However, the second sheet end alignment member is not limited to the paddle-shaped member, and a roller-shaped member or a belt-shaped member may be used.

(H05) In the embodiment, although, when the contained sheet number is large, the sheet ejecting directional rear end of the recording sheet is carried to the position of the main paddle 47 and then the sub paddle 103 is lifted to the standby position, the invention is not limited to this. For example, the sub paddle 103 may be lifted to the standby position before the recording sheet reach the main paddle 47 in the construction that the recording sheet can move toward the rear end position determination wall 41*a* by its own weight or inertia or after the recording sheet is carried to the main paddle 47 and sub paddle 103 at a predetermined time.

(H06) In the embodiment, although, when the contained sheet number is small, the sub paddle 103 is sustained in the sheet inserting position until the sheet ejecting directional rear end of the recording sheet contacts with the rear end position determination wall 41*a*, the invention is not limited to this. For example, the sub paddle 103 may be lifted to the standby position when the recording sheet is carried to the position which can be inserted by the main paddle 47.

(H07) In the embodiment, although the inserting position sustaining time is changed over according to two cases that the contained sheet number is small and large, the case that the inserting position sustaining time is changed may be divided into three.

(H08) In the embodiment, although the sub paddle 103 rotates in both the standby position and the sheet inserting position, the sub paddle 103 stops in the standby position, moves to the sheet inserting position, and rotates at a predetermined time (sheet inserting time).

(H09) In the embodiment, although the sub paddle 103 moves to the sheet inserting position whenever the recording sheet is received, since a first sheet received in the end binding compile tray is pulled the rotation of the ejecting roll 82 and the clamp roll 91 after ejecting the sheet bundle, the first sheet does not moves to the sheet inserting position and the sheet moves to the sheet inserting position and is pulled after a second sheet.

In order to easily correspond to elements of the embodiments, the elements of the present invention are added with reference numerals surrounded by parentheses. In addition, the reason that the later-described elements of the present invention are described with the corresponding reference numerals added is not for a limitation of the scope of the present invention but for an easy understanding for the present invention.

Aspects of the Present Invention

The present invention has been made in view of the above circumstances, and the post-processing apparatus according to a first aspect comprises the following components A01~A04;

(A01) a compile tray 7 for containing a recording sheet where an image is recorded, wherein the compile tray has a sheet end position determination portion 41*a* for contacting with an end edge of the contained recording sheet to determine a position thereof;

(A02) a first sheet end alignment member 47 for carrying the recording sheet received in the compile tray 7 to the sheet end position determination portion 41*a* and aligning the end edge of the recording sheet;

(A03) a second sheet end alignment member 103 capable of moving between a sheet carrying position and a standby position separated from the recording sheet, the second sheet end alignment member for contacting with the recording sheet received in the compile tray 7 and rotating to carry the recording sheet to the first sheet end alignment member 47; and (A04) second sheet end alignment member control unit CA7 for moving the second sheet end alignment member 103 between the sheet carrying position and the standby position, the second sheet end alignment member control unit changing a carrying position sustaining time for sustaining the second end alignment member 103 at the sheet carrying position according to the sheet number of the recording sheets contained in the compile tray 7.

Operations of First Aspect

In the post-processing apparatus according to the first aspect having the components A01~A04, the compile tray 7 for containing the recording sheets where the image is recorded has the sheet end position determination portion 41*a* for contacting with the end edges of the contained recording sheets and determining positions thereof. The first sheet end alignment member 47 carries the recording sheets received in the compile tray 7 to the sheet end position determination portion 41*a* and aligns the end edges of the recording sheets. The second sheet end alignment member 103 contacts with the recording sheets received in the compile tray 7 and rotates to carry the recording sheets to the first sheet end alignment member 47, where the second sheet end alignment member 103 can move between the sheet carrying position and the standby position separated from the recording sheets. The second sheet end alignment member control unit CA7 for moving the second sheet end alignment member 103 between the sheet carrying position and the standby position changes the carrying position sustaining time for sustaining the second sheet end alignment member 103 at the sheet carrying position according to the sheet number of the recording sheets contained in the compile tray 7.

First Embodiment of First Aspect

The post-processing apparatus according to a first embodiment of the first aspect comprises the following components A05~A07.

(A05) contained sheet number counting unit CA7 for counting a contained sheet number of the recording sheets contained in the compile tray 7;

(A06) sheet number storage unit CA7B1 for storing a sheet number for changing the carrying position sustaining time;

(A07) carrying position sustaining time setting unit CA7C for setting the carrying position sustaining time as a sustaining time t1 for a predetermined small sheet number in a case where a contained sheet number of the compile tray 7 is smaller than the sheet number for changing the carrying position sustaining time n1 and setting the carrying position sustaining time as a sustaining time t2 for a predetermined large sheet number which is shorter than the sustaining time t1 for the small sheet number in a case where a contained sheet number of the compile tray 7 is equal to or larger than the sheet number for changing the carrying position sustaining time n1.

Operations of First Embodiment of First Aspect

In the post-processing apparatus according to the first embodiment of the first aspect having components A05~A07, the contained sheet number counting unit CA7A counts the contained sheet number of the recording sheets contained in the compile tray 7. The sheet number storage unit CA7B1 stores the sheet number n1 for changing the carrying position sustaining time. The carrying position sustaining time setting unit CA7C sets the carrying position sustaining time as a sustaining time t1 for a predetermined small sheet number in a case where the contained sheet number of the compile tray 7 is smaller than the sheet number for changing the carrying position sustaining time n1 and sets the carrying position sustaining time as a sustaining time t3 for a predetermined large sheet number which is shorter than the sustaining time t1 for the small sheet number in a case where a contained sheet number of the compile tray 7 is equal to or larger than the sheet number for changing the carrying position sustaining time n1.

Second Embodiment of First Aspect

The post-processing apparatus according to a second embodiment of the fist aspect further comprises the following components A08 in the first embodiment of the first aspect.

(A08) the second sheet end alignment member control unit CA7 for sustaining the second sheet end alignment member 103 at the sheet carrying position until the end edge of the received recording sheet contacts with the sheet end position determination portion 41*a* in a case where the contained sheet number of the compile tray 7 is smaller than the sheet number for changing the carrying position sustaining time n1 and sustaining the second sheet end alignment member 103 at the sheet carrying position until the end edge of the received recording sheet is carried to the first sheet end alignment member 47 in a case where the contained sheet number of the compile tray 7 is larger than the sheet number for changing the carrying position sustaining time n1.

Operations of Second embodiment of First Aspect

In the post-processing apparatus according to the Second embodiment of the first aspect having the components A08, the second sheet end alignment member control unit CA7 sustains the second sheet end alignment member 103 at the sheet carrying position until the end edge of the received recording sheet contacts with the sheet end position determination portion 41*a* in a case where the contained sheet number of the compile tray 7 is smaller than the sheet number for changing the carrying position sustaining time n1 and sustains the second sheet end alignment member 103 at the sheet carrying position until the end edge of the received recording sheet is carried to the first sheet end alignment member 47 in a case where the contained sheet number of the compile tray 7 is larger than the sheet number for changing the carrying position sustaining time n1.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-256250 filed on Sep. 2, 2004 including specification, claims, drawings and abstract is incorporated herein by reference in its entirety.

What is claimed is:

1. A post-processing apparatus comprising:

a compile tray that contains a recording sheet, and has a sheet end position determination portion which contacts with and determines a position of an end edge of the contained recording sheet;

a first sheet end alignment member that carries the recording sheet received in the compile tray to the sheet end position determination portion and aligns the end edge of the recording sheet;

a second sheet end alignment member that moves between the sheet carrying position and a standby position, wherein the sheet carrying position is where the second sheet end alignment member contacts with the recording sheet to carry the recording sheet to a side of the first sheet end alignment member, and the standby position is separated from the recording sheet;

a second sheet end alignment member control unit that moves the second sheet end alignment member between the sheet carrying position and the standby position, and changes a carrying position sustaining time to sustain the second end alignment member at the sheet carrying position according to a sheet number of the recording sheets contained in the compile tray;

a contained sheet number counting unit that counts a sheet number of the recording sheets contained in the compile tray;

a sheet number storage unit that stores the sheet number for changing the carrying position sustaining time; and a carrying position sustaining time setting unit that sets the carrying position sustaining time to a predetermined sustaining time for small sheet number when a contained sheet number of the compile tray is smaller than the sheet number that changes the carrying position sustaining time, and sets the carrying position sustaining time to a predetermined sustaining time for large sheet number when a contained sheet number of the compile tray is equal to or larger than the sheet number for changing the carrying position sustaining time, wherein the second sheet end alignment member control unit sustains the second sheet end alignment member at the sheet carrying position until the end edge of the received recording sheet contacts with the sheet end position determination portion when the contained sheet number of the compile tray is smaller than the sheet number for changing the carrying position sustaining time, and sustains the second sheet end alignment member at the sheet carrying position until the end edge of the received recording sheet is carried to the first sheet end alignment member when the contained sheet number of the compile tray is larger than the sheet number for changing the carrying position sustaining time, and wherein the predetermined sustaining time for small sheet number is longer than the predetermined sustaining time for large sheet number, thereby preventing buckling of the end edge of the received recording sheet.

2. The post-processing apparatus according to claim 1, further comprising a front tamper and a rear tamper for aligning front and rear edges of the recording sheet received to the compile tray, wherein the front tamper includes a first sheet side end alignment wall upwardly erected from a front end of a first sheet mounting portion, and wherein the rear tamper includes a second sheet side end alignment wall upwardly erected from a front end of a second sheet mounting portion.

3. The post-processing apparatus according to claim 2, wherein the rear tamper further includes a plurality of convex portions formed on an inner surface of the second sheet side end alignment wall.

* * * * *